US008973666B2

(12) United States Patent
Purkis

(10) Patent No.: US 8,973,666 B2
(45) Date of Patent: Mar. 10, 2015

(54) RUNNING ADAPTER

(75) Inventor: Daniel Purkis, Aberdeen (GB)

(73) Assignee: Petrowell Limited, Aberdeen (GB)

( * ) Notice: Subject to any disclaimer, the term of this patent is extended or adjusted under 35 U.S.C. 154(b) by 0 days.

(21) Appl. No.: 13/189,758

(22) Filed: Jul. 25, 2011

(65) Prior Publication Data

US 2011/0277986 A1 Nov. 17, 2011

Related U.S. Application Data

(62) Division of application No. 11/577,866, filed on Oct. 3, 2007, now Pat. No. 8,490,691.

(30) Foreign Application Priority Data

Oct. 29, 2004 (GB) ..... 0423992.7
Oct. 28, 2005 (WO) ..... PCT/GB2005/004200

(51) Int. Cl.
*E21B 23/00* (2006.01)
*E21B 23/02* (2006.01)
*E21B 33/12* (2006.01)

(52) U.S. Cl.
CPC ..... *E21B 23/02* (2013.01); *E21B 33/12* (2013.01)
USPC ..... 166/382; 166/242.6

(58) Field of Classification Search
USPC ..... 166/242.6, 242.7, 382, 75.14
See application file for complete search history.

(56) References Cited

U.S. PATENT DOCUMENTS

| | | | |
|---|---|---|---|
| 643,358 | A | 2/1900 | Konold |
| 2,009,322 | A | 7/1935 | Emil |
| 2,181,748 | A | 11/1939 | Thaheld |
| 2,498,791 | A | 2/1950 | Clark |

(Continued)

FOREIGN PATENT DOCUMENTS

| | | |
|---|---|---|
| DE | 3812211 | 11/1989 |
| DE | 19827708 | 1/1999 |

(Continued)

OTHER PUBLICATIONS

Pursuant to MPEP §2001.6(b), applicant brings the following co-pending applications to the Examiner's attention: U.S. Appl. Nos. 13/122,186, 12/933,015, 12/866,495, 12/743,397, 12/743,505, 12/665,641, 12/514,488, 12/294,078, 11/909,820, 11/816,421, 11/577,866, and 11/570,335.

(Continued)

*Primary Examiner* — Sean Andrish
(74) *Attorney, Agent, or Firm* — Wong, Cabello, Lutsch, Rutherford & Brucculeri LLP

(57) ABSTRACT

A plug for sealing a conduit comprises a body having a first section and a second section, and at least one seal element for creating a seal between the plug and the conduit. The at least one seal element is adapted to be energized by movement in a setting direction of the first body section relative to the second body section. The plug further comprises seal locking means comprising a first portion and a second portion wherein as the at least one seal is energized, the seal locking means first portion is rotatable unidirectionally relative to the seal locking means second portion to take up the movement of the first body section relative to the second body section in the setting direction and prevent movement of the first body section relative to the second body section in a releasing direction, opposite the setting direction. In one embodiment the seal locking means first portion is a locking nut.

14 Claims, 21 Drawing Sheets

(56) References Cited

U.S. PATENT DOCUMENTS

| | | | | |
|---|---|---|---|---|
| 2,546,377 | A | 3/1951 | Turechek | |
| 2,738,018 | A | 3/1956 | Lynes | |
| 2,832,418 | A | 4/1958 | Baker | |
| 3,066,738 | A | 12/1962 | Myers | |
| 3,087,552 | A | 4/1963 | Graham | |
| 3,167,127 | A | 1/1965 | Sizer | |
| 3,167,128 | A | 1/1965 | Sutliff | |
| 3,283,821 | A | 11/1966 | Brown | |
| 3,342,268 | A | 9/1967 | Brown | |
| 3,371,716 | A | 3/1968 | Current | |
| 3,482,889 | A | 12/1969 | Cochran | |
| 3,623,551 | A | 11/1971 | Randermann | |
| 3,722,588 | A | 3/1973 | Tamplen | |
| 3,729,170 | A | 4/1973 | Lewis et al. | |
| 3,889,750 | A | 6/1975 | Mullins | |
| 4,046,405 | A | 9/1977 | Bonds | |
| 4,127,168 | A | 11/1978 | Hanson | |
| 4,317,485 | A | 3/1982 | Ross | |
| 4,331,315 | A | 5/1982 | Geisow | |
| 4,346,919 | A | 8/1982 | Morrill | |
| 4,375,240 | A | 3/1983 | Baugh | |
| 4,548,264 | A | 10/1985 | Manderscheid | |
| 4,588,030 | A | 5/1986 | Blizzard et al. | |
| 4,917,187 | A | 4/1990 | Burns | |
| 2,230,447 | A | 2/1991 | Bassinger | |
| 5,058,684 | A | 10/1991 | Winslow et al. | |
| 5,095,978 | A | 3/1992 | Akkerman | |
| 5,261,488 | A | 11/1993 | Gullet | |
| 5,542,473 | A | 8/1996 | Pringle | |
| 6,062,309 | A | 5/2000 | Gosse | |
| 6,315,041 | B1 | 11/2001 | Carlisle | |
| 7,028,780 | B2 * | 4/2006 | Maguire | 166/382 |
| 7,690,424 | B2 | 4/2010 | McLeod et al. | |
| 2003/0000607 | A1 | 1/2003 | Jenner | |
| 2004/0055757 | A1 | 3/2004 | Beall | |
| 2005/0224227 | A1 | 10/2005 | Hendrie | |
| 2009/0308592 | A1 | 12/2009 | Mercer | |

FOREIGN PATENT DOCUMENTS

| | | |
|---|---|---|
| EP | 0468668 | 1/1992 |
| EP | 0485080 | 5/1992 |
| EP | 1408195 | 4/2004 |
| GB | 755082 | 8/1956 |
| GB | 1257790 | 12/1971 |
| GB | 1364054 | 8/1974 |
| GB | 2118659 | 11/1983 |
| GB | 2224526 | 5/1990 |
| GB | 2245624 | 8/1992 |
| GB | 2328230 | 2/1999 |
| GB | 2428708 | 2/2007 |
| WO | WO02/42672 | 5/2002 |
| WO | WO2005026494 | 3/2005 |
| WO | WO2005121498 | 12/2005 |
| WO | WO2006/046075 | 5/2006 |
| WO | WO2007109878 | 10/2007 |

OTHER PUBLICATIONS

International Search Report for PCT/GB2009/000730, Dated Sep. 24, 2009. The corresponding document was previously submitted in connection with U.S. Appl. No. 11/577,866 and is not being resubmitted herewith per 37 CFR 1.98(d).

Written Opinion for PCT/GB2009/000730, Dated Sep. 18, 2010. The corresponding document was previously submitted in connection with U.S. Appl. No. 11/577,866 and is not being resubmitted herewith per 37 CFR 1.98(d).

Office Action, Applicant's co-pending U.S. Appl. No. 11/909,820, Dated Oct. 7, 2010. The corresponding document was previously submitted in connection with U.S. Appl. No. 11/577,866 and is not being resubmitted herewith per 37 CFR 1.98(d).

International Search Report for PCT/GB2009/000770, Dated Oct. 8, 2009. The corresponding document was previously submitted in connection with U.S. Appl. No. 11/577,866 and is not being resubmitted herewith per 37 CFR 1.98(d).

Written Opinion for PCT/GB2009/000770, Dated Sep. 29, 2010. The corresponding document was previously submitted in connection with U.S. Appl. No. 11/577,866 and is not being resubmitted herewith per 37 CFR 1.98(d).

International Preliminary Report on Patentability for PCT/GB2005/001391, Dated Jun. 23, 2005. The corresponding document was previously submitted in connection with U.S. Appl. No. 11/577,866 and is not being resubmitted herewith per 37 CFR 1.98(d).

International Search Report for PCT/GB2005/001391, Dated Jun. 23, 2005. The corresponding document was previously submitted in connection with U.S. Appl. No. 11/577,866 and is not being resubmitted herewith per 37 CFR 1.98(d).

Written Opinion for PCT/GB2005/001391, Dated Jun. 23, 2005. The corresponding document was previously submitted in connection with U.S. Appl. No. 11/577,866 and is not being resubmitted herewith per 37 CFR 1.98(d).

Written Opinion for PCT/GB2005/004200, Dated Apr. 10, 2006. The corresponding document was previously submitted in connection with U.S. Appl. No. 11/577,866 and is not being resubmitted herewith per 37 CFR 1.98(d).

International Preliminary Report on Patentability for PCT/GB2005/004200, Dated May 1, 2007. The corresponding document was previously submitted in connection with U.S. Appl. No. 11/577,866 and is not being resubmitted herewith per 37 CFR 1.98(d).

International Search Report for PCT/GB2005/004200, Dated Jan. 11, 2006. The corresponding document was previously submitted in connection with U.S. Appl. No. 11/577,866 and is not being resubmitted herewith per 37 CFR 1.98(d).

International Preliminary Report on Patentability for PCT/GB2005/003871, Dated Sep. 11, 2007. The corresponding document was previously submitted in connection with U.S. Appl. No. 11/577,866 and it not being resubmitted herewith per 37 CFR 1.98(d).

International Search Report for PCT/GB2005/003871, Dated Nov. 17, 2005. The corresponding document was previously submitted in connection with U.S. Appl. No. 11/577,866 and is not being resubmitted herewith per 37 CFR 1.98(d).

Office Action, Applicant's co-pending U.S. Appl. No. 11/816,421, Dated Mar. 30, 2009. The corresponding document was previously submitted in connection with U.S. Appl. No. 11/577,866 and is not being resubmitted herewith per 37 CFR 1.98(d).

Office Action, Applicant's co-pending U.S. Appl. No. 11/816,421, Dated Sep. 28, 2009. The corresponding document was previously submitted in connection with U.S. Appl. No. 11/577,866 and is not being resubmitted herewith per 37 CFR 1.98(d).

Foreign Office Action for UK/20051101, Dated Nov. 1, 2005. The corresponding document was previously submitted in connection with U.S. Appl. No. 11/577,866 and is not being resubmitted herewith per 37 CFR 1.98(d).

Written Opinion for PCT/GB2005/003871, Dated Nov. 22, 2005. The corresponding document was previously submitted in connection with U.S. Appl. No. 11/577,866 and is not being resubmitted herewith per 37 CFR 1.98(d).

International Preliminary Report on Patentability and Written Opinion for PCT/GB2006/001297, Dated Oct. 9, 2007. The corresponding document was previously submitted in connection with U.S. Appl. No. 11/577,866 and is not being resubmitted herewith per 37 CFR 1.98(d).

International Search Report for PCT/GB2006/001297, Dated Oct. 9, 2007. The corresponding document was previously submitted in connection with U.S. Appl. No. 11/577,866 and is not being resubmitted herewith per 37 CFR 1.98(d).

Office Action, Applicant's co-pending U.S. Appl. No. 11/909,820, Dated May 29, 2009. The corresponding document was previously submitted in connection with U.S. Appl. No. 11/577,866 and is not being resubmitted herewith per 37 CFR 1.98(d).

Office Action, Applicant's co-pending U.S. Appl. No. 11/909,820, Dated Feb. 17, 2010. The corresponding document was previously submitted in connection with U.S. Appl. No. 11/577,866 and is not being resubmitted herewith per 37 CFR 1.98(d).

International Search Report for PCT/GB2007/001040, Dated Jun. 5, 2010. The corresponding document was previously submitted in

(56) References Cited

OTHER PUBLICATIONS connection with U.S. Appl. No. 11/577,866 and is not being resubmitted herewith per 37 CFR 1.98(d).
International Preliminary Report on Patentability and Written Opinion for PCT/GB2007/001040, Dated Sep. 23, 2008. The corresponding document was previously submitted in connection with U.S. Appl. No. 111577,866 and is not being resubmitted herewith per 37 CFR 1.98(d).
International Preliminary Report on Patentability and Written Opinion for PCT/GB2007/004372, Dated May 19, 2009. The corresponding document was previously submitted in connection with U.S. Appl. No. 11/577,866 and is not being resubmitted herewith per 37 CFR 1.98(d).
International Search Report for PCT/GB2007/004372, Dated Jan. 23, 2008. The corresponding document was previously submitted in connection with U.S. Appl. No. 11/577,866 and is not being resubmitted herewith per 37 CFR 1.98(d).
International Preliminary Report on Patentability and Written Opinion for PCT/GB2008/002042, Dated Dec. 20, 2009. The corresponding document was previously submitted in connection with U.S. Appl. No. 11/577,866 and is not being resubmitted herewith per 37 CFR 1.98(d).
International Search Report for PCT/GB2008/002042, Dated Oct. 17, 2008. The corresponding document was previously submitted in connection with U.S. Appl. No. 11/577,866 and is not being resubmitted herewith per 37 CFR 1.98(d).
International Preliminary Report on Patentability and Written Opinion for PCT/GB2009/071874, Dated Jun. 8, 2010. The corresponding document was previously submitted in connection with U.S. Appl. No. 11/577,866 and is not being resubmitted herewith per 37 CFR 1.98(d).
International Search Report for PCT/GB2009/071874, Dated Jul. 23, 2009. The corresponding document was previously submitted in connection with U.S. Appl. No. 11/577,866 and is not being resubmitted herewith per 37 CFR 1.98(d).
International Preliminary Report on Patentability and Written Opinion for PCT/GB2008/003883, Dated May 25, 2010. The corresponding document was previously submitted in connection with U.S. Appl. No. 11/577,866 and is not being resubmitted herewith per 37 CFR 1.98(d).
International Search Report for PCT/GB2008/003883, Dated Mar. 26, 2009. The corresponding document was previously submitted in connection with U.S. Appl. No. 11/577,866 and is not being resubmitted herewith per 37 CFR 1.98(d).
International Preliminary Report on Patentability and Written Opinion for PCT/GB2009/00048300, Dated Aug. 24, 2010. The corresponding document was previously submitted in connection with U.S. Appl. No. 11/577,866 and is not being resubmitted herewith per 37 CFR 1.98(d).
International Search Report for PCT/GB2009/00048300, Dated Sep. 28, 2009. The corresponding document was previously submitted in connection with U.S. Appl. No. 11/577,866 and is not being resubmitted herewith per 37 CFR 1.98(d).
UK "Search Report" for application No. GB0813635.0 dated Aug. 12, 2008.
UK "Combined Search and Examination Report" for application No. GB0813635.0 dated Aug. 14, 2008.

* cited by examiner

REPLACEMENT SHEET

2/21

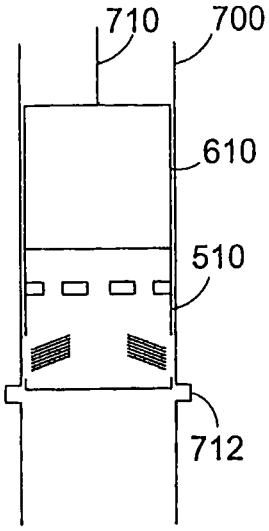
Fig. 23a
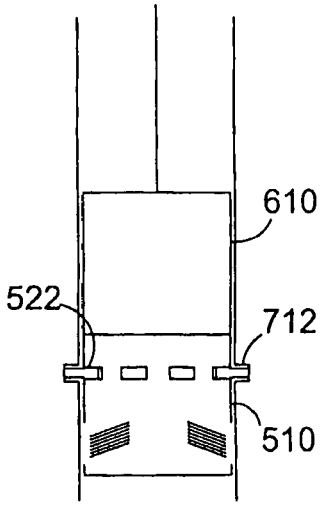
Fig. 23b
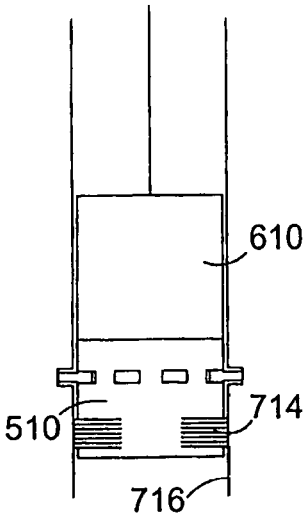
Fig. 23c
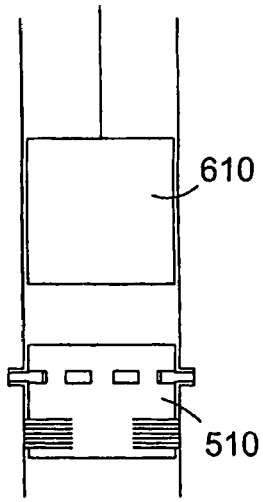
Fig. 23d
Fig. 23

RUNNING ADAPTER

FIELD OF THE INVENTION

The present invention relates to plugs, particularly to plugs for sealing wellbores and christmas trees.

BACKGROUND OF THE INVENTION

Conventionally wellbores, and christmas trees associated with wellbores, have been sealed with plugs having three basic parts: an anchoring system, a sealing element and a setting system.

The first stage in setting a conventional plug is anchoring the plug in the wellbore. Anchoring systems for conventional wellhead plugs use a set of locking dogs, which engage a recessed profile in the wellbore or tree, or use a set of slips which "bite" the casing to hold the plug in place.

The seal is then set using a linear action setting mechanism to create a linear displacement to deform the seal element. The force required to create the seal is then locked in using a linear locking mechanism. In wellbore applications the seal is generally a metal-to-metal seal formed by swaging a metal ring element into the bore or onto a no-go shoulder.

To provide a seal capable of withstanding well pressures, the required setting force needs to be as high as the maximum force generated by the well pressure.

In recent years a number of high pressure, high temperature, high flow rate wells have been completed which have highlighted shortcomings in conventional designs of well bore plugs and tree plugs. For example, swaged seals can dislodge when exposed to the high pressure, temperature and vibration cycles of these wells, and the jarring action used to set the seal can damage the plug or the surrounding environment.

Additionally, linear locking mechanisms have a degree of backlash which in a high temperature, pressure and vibration cycle environment can lead to failure.

A further disadvantage of conventional plugs is the expansion achievable from the metal seal element is not sufficient to permit the plug to be run into the wellbore with adequate clearance between the plug and the wellbore to prevent a build-up of pressure in front of the plug, resisting the placement of the plug. This can be a particular problem when a number of plugs are to be located in series in a conduit, as a hydraulic lock can be formed between plugs.

It is an object of the present invention to obviate or mitigate at least one of the aforementioned disadvantages.

SUMMARY OF THE INVENTION

According to a first aspect of the present invention there is provided a plug for sealing a conduit, the plug comprising:

a body having a first section and a second section;

at least one seal element for creating a seal between the plug and a conduit, the at least one seal element being adapted to be energised by movement in a seal setting direction of the first body section relative to the second body section; and seal locking means comprising a first portion and a second portion;

wherein as the at least one seal is energised, the seal locking means first portion is rotatable unidirectionally relative to the seal locking means second portion to take up the movement of the first body section relative to the second body section in the seal setting direction and prevent movement of the first body section relative to the second body section in a releasing direction, opposite the seal setting direction.

Preferably, the seal locking means is arranged along an arc centred on, and substantially perpendicular to, a longitudinal axis of the plug.

The use of unidirectional rotational locking means to take up movement of the first body section relative to the second body section, particularly when arranged along an arc centred on, and substantially perpendicular to, the longitudinal axis of the plug provides a tree plug in which the possibility of the seal element partially releasing due to backlash is minimised.

Movement of the first body section relative to the second body section covers situations in which the first body section is stationary and the second body section moves, the first body section moves and the second body section is stationary, or both body sections move.

Preferably, the plug is adapted to be connected to a running adapter.

Preferably, the at least one seal element is adapted to be energised by axially translating the first body section relative to the second body section in the setting direction.

Preferably, the plug is adapted to be set by the application of linear forces to one or both of the first body section and the second body section to axially translate the first body section relative to the second body section in the setting direction.

Alternatively, the at least one seal element is adapted to be energised by rotationally translating the first body section relative to the second body section in the setting direction.

Preferably, the first body section is a plug housing, or part of a plug housing.

Preferably, the second body section is a seal setting means.

Preferably, the running adapter is adapted to apply rotational forces to one or both of the housing and the seal setting means to rotationally translate the housing relative to the seal setting means in the setting direction. Rotation of the housing relative to the seal setting means may additionally cause the seal setting means to translate axially along the housing.

Preferably, rotation of the seal setting means causes the seal setting means to translate axially along the housing.

Preferably, the seal setting means translates axially along the housing by means of a threaded connection.

Preferably, the threaded connection comprises a first thread located on an external surface of the setting means and a complementary second thread located on an internal surface of the housing.

One or each of the first and second portions may be integral with one of the first and second body sections.

Preferably, the seal locking means first portion comprises at least one locking member which engages the seal locking means second portion.

Preferably, the/each locking member is biased against the seal locking means second portion.

Preferably, the/each locking member is located within a respective channel defined by the first portion.

Preferably, the/each channel is angled to an interface between the first and second portions. Most preferably, the angle between the/each channel and the interface between the first and second portions is an acute angle. The/each channel may be tapered.

Preferably, the locking member is biased by a spring.

Preferably, the/each locking member is a ball bearing. In use a ball bearing, located in an angled channel and biased against the second portion, will permit relative movement between the first and second portions in one direction, but not in the opposite direction.

Preferably, the seal locking means first portion is a locking nut.

Preferably, the locking nut is connected to the second body section by a threaded connection. Having the seal locking means arranged on an arc which is centred on and is substantially perpendicular to the longitudinal axis of the housing virtually eliminates backlash generally present when movement between the locking nut and the second body section is facilitated by a threaded connection.

Preferably, a first portion of the locking nut is split axially into a plurality locking nut sections.

Preferably, there are six locking nut sections.

Preferably, each of the locking nut sections is connected to a second locking nut portion.

Most preferably, each of the locking nut sections is permitted to move radially relative to the second locking nut portion.

Preferably, each of the locking nut sections is connected to the second locking nut portion by means of a dovetail connection.

Preferably, the seal locking means further comprises a retaining sleeve.

Preferably, the retaining sleeve prevents radial movement of the locking nut sections.

Preferably, the retaining sleeve is releasably connected to the locking nut.

Preferably, the retaining sleeve is releasably connected to the locking nut by means of at least one shear screw or pin.

In an alternative embodiment, the seal locking means is a first unidirectional latching means.

Preferably, the first unidirectional latching means is a seal ratchet, the seal ratchet comprising a set of seal ratchet teeth and at least one complementary seal ratchet pawl, the set of seal ratchet teeth being associated with one of the seal locking means portions, the at least one complementary seal ratchet pawl being associated with the other of the seal locking means portions.

Alternatively, the first unidirectional latching means comprises a first set latching teeth or castellations associated with one of the seal locking means portions and a second set of latching teeth or castellations associated with the other of the seal locking means portions.

Having a seal ratchet mechanism arranged on an arc which is centred on and is substantially perpendicular to the longitudinal axis of the housing virtually eliminates backlash generally present when movement between the seal setting means and the housing is facilitated by a threaded connection. For example, if the threaded connection had 10 threads per inch, the potential backlash with a linear body lock ring without the rotational ratchet mechanism would be 0.1 inches, however by utilising the seal ratchet mechanism described above with, for example, 36 teeth, the backlash is reduced to (0.1/36) inches or 0.0028 inches.

Preferably, the seal ratchet teeth are located on an internal surface of a portion of the first body section and the at least one seal ratchet pawl is located on a portion of the second body section. In this case the portion of the second body section may comprise an annular locking ring having a radially inner surface and a radially outer surface, the at least one seal pawl being located on the radially outer surface of the locking ring.

Alternatively, the seal ratchet teeth are located on an external surface of a portion of the second body section and the at least one seal ratchet pawl is located on a portion of the first body section. In this case the portion of the first body section may comprise an annular locking ring having a radially inner surface and a radially outer surface, the at least one seal pawl being located on the radially inner surface of the locking ring.

Preferably, the at least one seal element is a metal seal element.

Preferably, the at least one seal element is a stack of frusto-conical washers. Frusto-conical washers are also known as disc springs or Belleville Washers™

Alternatively, the at least one seal element is a plurality of metal seals, or a combination of metal and plastic seals.

Preferably, at least one frusto-conical washer in the stack is adapted to form an independent metal-to-metal seal with a conduit from at least one other frusto-conical washer in the stack.

Preferably, the frusto-conical washers are steel. Most preferably, the frusto-conical washers are Inconel™.

Preferably, the frusto-conical washers are coated with silver. Most preferably, the silver coating is approximately 35 nm thick.

Preferably, adjacent washers or seals are separated by at least one layer of softer material.

Preferably, the softer material is polymeric.

Preferably, the at least one layer is a laminate of softer material. Most preferably, the at least one layer is a laminate of a number of softer materials. In one embodiment the laminate is a layer of PTFE sandwiched between layers of PEEK.

In a further alternative, the at least one seal element may be multiple metal seals of differing hardness.

Preferably, the at least one seal element is energised by compression.

Preferably, where the at least one seal element is a stack of frusto-conical washers, in the uncompressed state each washer is at an angle of 8° to the horizontal.

Preferably, where the at least one seal element is a stack of frusto-conical washers, when the at least one seal element is energised, the washers are not flattened. Most preferably, in the energised configuration, each frusto-conical washer is at an angle of 5° to the horizontal. Retaining a slight angle, assists in the recovery of the frusto-conical washers to their original shape when the seal is released.

A metal seal element is required for use in wellbores. A stack of frusto-conical washers is preferred because a high expansion ratio is achievable by compression of a frusto-conical washer, permitting the plug to be run into position without building up a significant head of pressure in front of the plug. A further advantage of the frusto conical washer is the expansion is an elastic expansion; the plug can be easily removed from the conduit by releasing the compression force on the washers, thereby reversing the expansion of the seal element sufficiently to permit removal of the plug from the conduit. Additionally because the stack of frusto-conical washers is a smaller diameter than the target seal prior to and after sealing there is no requirement for jarring and no damage is done to the seal bore in the conduit. As no jarring is required to set the seal, the plug can be set by a running adapter which uses e-line or slick-line.

The use of a softer material between adjacent washers allows a tight seal to be obtained in a damaged conduit. As the stack is compressed the softer material is squeezed radially outwards into engagement with the damaged conduit.

Preferably, in an uncompressed configuration, the stack of frusto-conical washers describes an external diameter less than that of the plug body. This arrangement means the plug can be run in without the seal element being damaged on the conduit.

Preferably, the first body section includes a shoulder. Most preferably, the shoulder extends outwardly from the first body section.

Preferably, the shoulder is adapted to engage a no-go in the conduit. Providing a shoulder permits the plug to be landed on a conduit no-go ensuring the plug is set in the correct location.

Preferably, the plug further includes at least one anchor for securing the plug to the conduit, and an anchor setting means, the at least one anchor being adapted to engage the conduit by movement in an anchor setting direction of one of the first or second body sections relative to the anchor setting means.

Preferably, the/each anchor is at least one dog which is adapted to engage a recess in the internal surface of a conduit.

Alternatively, the at least one anchor may be at least one slip which is adapted to engage the internal surface of a conduit.

Preferably, the at least one dog is adapted to be moved radially outward from the plug.

Preferably, the/each at least one dog is adapted to be moved radially outwards by an anchor ramp.

Preferably, the anchor ramp is adapted to engage the at least one dog and apply a radially outward force to the at least one dog.

Most preferably, the anchor ramp has a tapered surface for engaging a complementary tapered surface on the at least one dog such that movement of the anchor ramp in a setting direction will force the at least one dog radially outwards.

Preferably, the tapered surface of the anchor ramp has a variable taper.

Preferably, the anchor ramp is a sleeve.

Preferably, the/each dog has a surface adapted to engage a complementary surface in the recess. Most preferably, the complementary surfaces are adapted, once engaged, to convert the radially outward force into a downward force on the plug. This arrangement is especially useful when used in conjunction with a conduit no-go as the downward force will be resisted by the no-go, thereby securing the plug in place.

Preferably, the other of the first or second body sections and the anchor setting means are the same. Most preferably, the seal setting direction is the same as the anchor setting direction.

Preferably, the seal locking means is also an anchor locking means adapted to take up movement of the first body section relative to the anchor setting means in the setting direction and prevent the first or second body section moving relative to the anchor setting means in a releasing direction.

Preferably, in this case, the seal locking means second portion acts on the anchor ramp.

Alternatively, the second body section and the anchor setting means are different.

In this case, preferably, the first body section is a plug housing, and the second body section is a seal setting means.

Preferably, the at least one anchor is set by rotationally translating the anchor setting means relative to the housing.

Preferably, the anchor setting means and the housing are at least partially connected by second unidirectional latching means arranged along an arc centred on, and substantially perpendicular, to the longitudinal axis such that unidirectional rotational movement of one of the anchor setting means or the housing with respect to the other of the anchor setting means and the housing to set the at least one anchor with the conduit is permitted.

Preferably, the second unidirectional latching means is an anchor ratchet, the anchor ratchet comprising a set of anchor ratchet teeth and at least one complementary anchor ratchet pawl, the set of anchor ratchet teeth being associated with one of the anchor setting means or the housing, the at least one complementary anchor pawl being associated with the other of the anchor setting means or the housing.

Alternatively, the second unidirectional latching means comprises a set latching teeth or castellations associated with the anchor setting means and a set of latching teeth or castellations associated with the housing.

Preferably, rotation of the housing or the anchor setting means causes the anchor setting means to translate axially along the housing. Most preferably, rotation of the anchor setting means causes the anchor setting means to translate axially along the housing. The anchor setting means may translate axially along the housing by means of a threaded connection.

The anchor ratchet teeth may be located on an internal surface of a portion of the housing and the at least one anchor ratchet pawl located on a portion of the anchor setting means. In this case, the portion of the anchor setting means may comprise an annular locking ring having a radially inner surface and a radially outer surface, the at least one anchor pawl being located on the radially outer surface of the locking ring.

Alternatively, the anchor ratchet teeth may be located on an external surface of a portion of the anchor setting means and the at least one anchor ratchet pawl located on a portion of the housing. In this case, the portion of the housing may comprise an annular locking ring having a radially inner surface and a radially outer surface, the at least one anchor ratchet pawl being located on the radially inner surface of the locking ring.

Preferably, the direction of rotation for setting the at least one the anchor is opposite to the direction of rotation for setting the at least one seal. Having opposite directions of rotation for setting the at least one anchor and the at least one seal enables setting the plug to be a two stage process.

Preferably, to release the at least one seal element, the second body section is moveable relative to the at least one seal element.

Preferably, the second body section is moveable from a set position to a released position, such that in the set position, a seal is formed between the at least one seal element and the second body section and in the released position there is a flow path between the at least one seal element and the second body section.

Preferably, the flow path is provided by at least one groove defined by the second body section.

Preferably, the plug further comprises a flow path locking means to lock the plug in the released position. This arrangement prevents the seal element being inadvertently reset after an operator believes the seal element has been released.

Preferably, the plug is provided with a sealed reservoir for location below the at least one seal, the reservoir comprising a housing containing a body of air at a fixed pressure, such that the reservoir is adapted to collapse or rupture in response to a threshold external pressure being exceeded.

Such an arrangement assists in the situation where it is desired to set two plugs adjacent to each other. In such a situation, after the first plug is set, an increase in pressure in the space between the two plugs can occur. This increase in pressure will apply a load against the seal elements of each plug and may affect the integrity of the seal. Providing a sacrificial reservoir substantially mitigates this problem as the increased pressure, once it exceeds a predetermined threshold pressure will rupture or collapse the reservoir permitting a reduction in pressure overall.

Preferably, the body of air in the sealed reservoir is at substantially atmospheric pressure.

According to a second aspect of the present invention there is provided a running adapter for setting a plug in a conduit, the running adapter arranged to convert a rotary input force into a rotary and an axial output force.

Preferably, the rotary output force is provided separately from the axial output force.

In one embodiment, the adapter comprises an input mandrel, an output mandrel, an adapter casing, and a locking sleeve.

Preferably, the adapter is arranged such that rotation of the input mandrel causes axial movement of the output mandrel relative to the adapter casing, and causes rotational movement of the locking sleeve.

Preferably, the input mandrel is adapted to be connected to a rotary drive.

Preferably, the adapter casing is adapted to engage a plug first body section.

Preferably, the output mandrel is adapted to engage a plug second body section.

Preferably, the locking sleeve is adapted to engage a plug seal locking means.

Preferably, the locking sleeve is adapted to selectively engage the input mandrel. Most preferably, the locking sleeve is adapted to selectively rotate with the input mandrel.

Preferably, the running adapter further comprises a locking sleeve clutch to disengage the locking sleeve from the input mandrel.

Preferably, the adapter casing is connected to the input mandrel by a threaded connection. Using a threaded connection converts rotation of the input mandrel to axial movement of the adapter casing with respect to the input mandrel.

Preferably, the output mandrel is axially fixed to the input mandrel. Most preferably, the output mandrel is rotationally independent of the input mandrel.

Preferably, a bearing interface is provided between the input mandrel and the output mandrel. A bearing interface permits the input mandrel to rotate with respect to the output mandrel.

Preferably, the output mandrel includes a bearing surface. There is the possibility that the bearing interface between the input and output mandrels might fail, in this case the output mandrel would rotate. If the output mandrel is directly or indirectly attached to a plug second body section, a bearing surface will reduce the possibility of damage to the second body section.

Preferably, the running adapter further comprises a latch, the latch being adapted to be located, in use, between the output mandrel and a plug second body section.

In an alternative embodiment, the running adapter comprises a tubular member having a longitudinal axis, an outer surface and an inner surface, one of the outer surface or the inner surface adapted to engage a portion of a plug seal setting means to set an at least one plug seal element, wherein the at least one plug seal element is set by rotation of the running adapter in a first direction about the longitudinal axis.

Preferably, the running adapter is adapted to disengage from the plug seal setting means when rotation about the longitudinal axis is in a direction opposite to the first direction.

Preferably, the inner surface of the tubular member is adapted to engage a portion of an external surface of the plug seal setting means.

Preferably, the inner surface of the tubular member is adapted to engage the plug seal setting means by means of at least one first engagement element, the at least one first engagement element adapted to engage with at least one first complementary notch in the portion of the external surface of the plug seal setting means to rotate the plug seal setting means.

Preferably, the at least one first engagement element is arranged only to engage the at least one first complementary notch when rotation is in the first direction.

The at least one first engagement element may be pivotally mounted in an at least one first recess in the tubular member, the at least one first engagement element being biased to a position in which the at least one first engagement element sits proud of the inner surface of the tubular member, such that when rotation is in the opposite direction the outer surface of the plug seal setting means depresses the at least one first engagement member into the at least one first tubular member recess.

The outer surface of the running adapter tubular member may be adapted to engage with a portion of the internal surface of an inner plug anchor setting means to set at least one plug anchor, wherein the at least one plug anchor is set by rotation of the running adapter in the opposite direction about the longitudinal axis.

Preferably, the running adapter is disengaged from the plug anchor setting means when rotation about the longitudinal axis is in the first direction.

Preferably, the outer surface of the tubular member is adapted to engage the plug anchor setting means by means of at least one second engagement element, the at least one second engagement element adapted to engage with at least one second complementary notch in the portion of the internal surface of the plug anchor setting means to rotate the anchor setting means.

Preferably, the at least one second engagement element is arranged only to engage the at least one second complementary notch when rotation is in the opposite direction.

The at least one second engagement element may be pivotally mounted in an at least one second recess in the tubular member, the at least one second engagement element being biased to a position in which the at least one second engagement element sits proud of the outer surface of the tubular member, such that when rotation is in the first direction the inner surface of the plug anchor setting means depresses the at least one second engagement member into the at least one second tubular member recess.

The adapter described in the alternative embodiment will set a plug by firstly setting the plug anchors by rotating the adapter in one direction, and then set the plug seal by rotating the adapter in the other direction.

According to a third aspect of the present invention there is provided a method of sealing a plug in a conduit, the method comprising the steps of:

disposing a plug in a conduit;

moving a plug first body section relative to a plug second body section in a setting direction to energise at least one seal element into a sealing engagement with the conduit;

unidirectionally rotating a seal locking means first portion relative to a seal locking means second portion to take up the movement of the plug first body section relative to the plug second body section, substantially preventing the plug first body section moving relative to the plug second body section in a releasing direction, opposite the setting direction.

Preferably, the seal locking means is arranged along an arc centred on, and substantially perpendicular, to a housing longitudinal axis.

In one embodiment, the step of moving a plug first body section relative to a plug second body section in a setting direction comprises applying a linear force to one or both of the plug first body section and/or the plug second body section to move the plug first body section axially relative to the plug second body section.

In an alternative embodiment, the step of moving a plug first body section relative to a plug second body section in a setting direction comprises rotating the plug second body section to rotationally translate the plug second body section relative to the first body section.

Preferably, following the step of disposing the plug in the conduit, the method comprises the additional steps of:

moving one of a plug's first or second body sections relative to a plug anchor setting means in a setting direction to energise at least one anchor into an anchored engagement with the conduit;

unidirectionally rotating an anchor locking means first portion relative to an anchor locking means second portion to take up the movement of said plug body section relative to the anchor setting means, substantially preventing said plug body section moving relative to the plug anchor setting means in a releasing direction, opposite the setting direction.

Preferably, the anchor locking means is arranged along an arc centred on, and substantially perpendicular, to a housing longitudinal axis.

Preferably, the anchor setting means is the same as the other of the plug's first or second body sections.

In one embodiment, the step of moving the plug's first or second body sections relative to a plug anchor setting means in a setting direction comprises applying a linear force to one or both of the plug body section and/or the plug anchor setting means to move the plug body section axially relative to the plug anchor setting means.

In an alternative embodiment, the step of moving a plug's first or second body sections relative to a plug anchor setting means in a setting direction comprises rotating a plug anchor setting means to rotationally translate the plug anchor setting means relative to the plug body section.

In this alternative embodiment the seal setting direction may be opposite the anchor setting direction.

According to a fourth aspect of the present invention there is provided a system for sealing a conduit, the system comprising a plug according to the first aspect of the present invention and a running adapter according to the second aspect of the present invention.

According to a fifth aspect of the present invention there is provided a plug for sealing a conduit, the plug comprising:

a first body section;

a second body section having an energising portion and a de-energising portion; and at least one seal element for creating a seal between the plug and a conduit, the at least one seal element being energised and de-energised by movement of the first body section relative to the second body section;

such that to energise the seal, the energising portion of the second body section is engaged with the at least one seal element and to de-energise the seal the de-energising portion of the second body section is engaged with the at least one seal element, the de-energising portion defining a fluid flow path around the at least one seal element.

Provision of a de-energising portion permits, when the plug is sealed in a conduit, pressure equalisation across the seal element, which prevents the possibility of the plug being blown up the conduit by pressure trapped below the plug.

According to a sixth aspect of the present invention there is provided a plug for sealing a conduit, the plug comprising:

a body having a first body section and a second body section; and at least one seal element for creating a seal between the plug and the conduit, the at least one seal element being set by relative movement between the first body section and the second body section;

wherein the at least one seal element comprises at least one frusto-conical washer.

According to a seventh aspect of the present invention there is provided a plug for sealing a conduit, the plug comprising:

a tubular housing having a longitudinal axis; and at least one circular seal element for creating a seal between the plug and a conduit, the at least one seal element being moveable between a de-energised configuration and an energised configuration;

wherein, in the de-energised configuration, the at least one seal element is describes a circumference less than the circumference of the housing.

Providing a seal element which in a de-energised configuration describes a circumference less than the circumference of the housing means there is no requirement for jarring to locate the plug in a conduit and, accordingly, no damage is done to the conduit bore during location.

According to an eighth aspect of the present invention there is provided a method of anchoring a plug in a conduit, the method comprising the steps of:

lowering a plug into a conduit until a portion of the plug engages a no-go located on a surface of the conduit preventing further movement of the plug in an axially downward direction; radially expanding at least one anchor into an at least one complementary recess in the conduit;

engaging a first surface of the/each anchor with a first surface of the/each recess, the/each first anchor surface and first recess surface being arranged to apply an axial load on the plug in the direction of the plug portion.

Preferably, the plug portion is a shoulder.

According to a ninth aspect of the present invention there is provided a method of retrieving a plug from a conduit, the method comprising the steps of:

de-energising at least one seal element, the at least one seal element forming a seal between the plug and a conduit;

releasing at least one plug anchor, the plug anchor anchoring the plug with respect to the conduit; and retrieving the plug to surface.

De-energising the seal element prior to releasing the plug anchors permits pressure equalisation across the seal element and prevents the possibility of the plug being blown up the conduit by pressure trapped below the plug when the anchors are released.

Preferably, the step of de-energising the at least one seal element comprises creating a fluid flow path across the at least one seal element.

Preferably, the step of creating a fluid flow path across the at least one seal element comprises moving a plug body portion relative to the at least one seal element.

Most preferably, the plug body portion has a de-energising region defining a fluid flow path for location behind the at least one seal element.

According to a tenth aspect of the present invention there is provided a sealed reservoir for location between a pair of adjacent seals, the reservoir comprising a housing containing a body of air at a fixed pressure;

wherein the reservoir is adapted to collapse or rupture in response to a threshold external pressure being exceeded.

According to an eleventh aspect of the present invention there is provided a plug for sealing a conduit, the plug comprising:

a housing having a longitudinal axis;

at least one seal element for creating a seal between the plug and the conduit;

seal setting means for setting the at least one seal element by rotationally translating one of the seal setting means or the housing with respect to the other of the seal setting means or the housing such that the at least one seal element is compressed into a sealing engagement with the conduit, the seal setting means and the housing being at least partially connected by first unidirectional latching means arranged along an arc centred on, and substantially perpendicular, to the longitudinal axis such that unidirectional rotational movement of one of the seal setting means or the housing with respect to the other of the seal setting means and the housing to compress the at least one seal element is permitted to set the seal.

According to a twelfth aspect of the present invention there is provided a running adapter for setting a plug in a conduit, the running adapter comprising a tubular member having a longitudinal axis, an outer surface and an inner surface, one of the outer surface or the inner surface adapted to engage a portion of plug seal setting means to set at least one plug seal element, wherein the at least one plug seal element is set by rotation of the running adapter in a first direction about the longitudinal axis.

According to a thirteenth aspect of the present invention there is provided a method of sealing a plug in a conduit, the method comprising the steps of:

disposing a plug in the conduit, the plug having a housing and a longitudinal axis;

rotating a plug seal setting means in a first direction to rotationally translate either of the plug seal setting means or the housing with respect to the other of the plug seal setting means or the housing such that an at least one seal element is compressed into a sealing engagement with the conduit, maintaining the sealing engagement by providing a seal ratchet arranged along an arc centred on, and substantially perpendicular, to the longitudinal axis, the seal ratchet comprising a set of seal ratchet teeth and at least one complementary seal ratchet pawl, the set of seal ratchet teeth being associated with one of the seal setting means or the housing, the at least one complementary seal ratchet pawl being associated with the other of the seal setting means or the housing.

According to a fourteenth aspect of the present invention there is provided a plug for sealing a conduit, the plug comprising:

a housing having a longitudinal axis;

at least one seal element for creating a seal between the plug and the conduit;

at least one anchor for anchoring the plug to a conduit;

anchor setting means for setting the anchor by rotationally translating one of the anchor setting means or the housing with respect to the other of the anchor setting means or the housing; and an anchor ratchet, the anchor ratchet comprising a set of anchor ratchet teeth and at least one complementary anchor ratchet pawl, the set of anchor ratchet teeth being associated with one of the anchor setting means or the housing, the at least one complementary anchor pawl being associated with the other of the anchor setting means or the housing, wherein the anchor ratchet is arranged along an arc centred on, and substantially perpendicular, to the longitudinal axis.

It will be understood that any of the preferred or alternative features of one aspect of the invention are equally applicable to a different aspect of the invention.

By virtue of the present invention a plug is provided from which backlash is substantially reduced.

BRIEF DESCRIPTION OF THE DRAWINGS

The present invention will now be described, by way of example, with reference to the accompanying figures in which:

FIG. 23, comprising FIGS. 23*a* to 23*d* is a schematic of the plug of FIG. 17 being set in a wellbore.

DETAILED DESCRIPTION OF THE DRAWINGS

Figure 1:
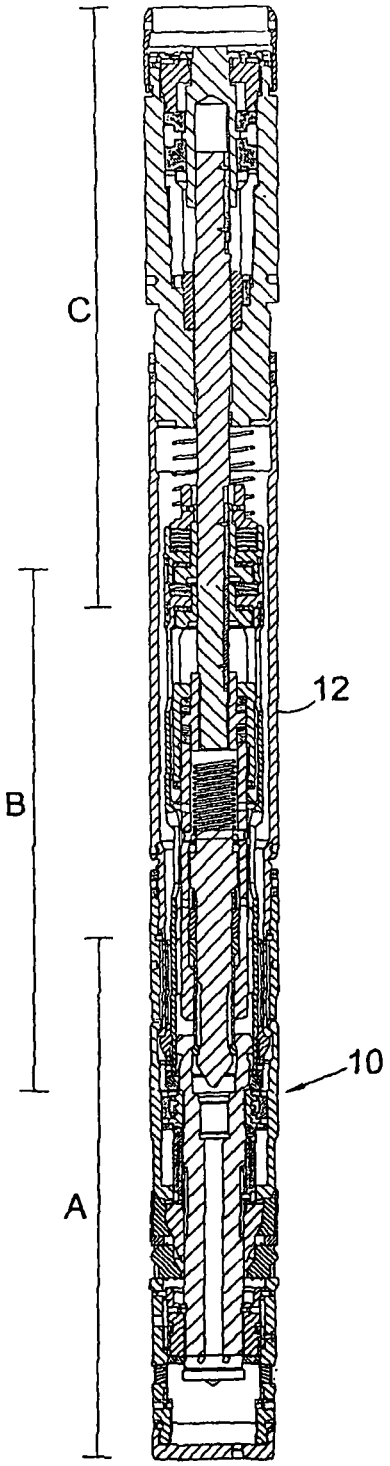
FIG. 1 is a cut away side view of a plug, for sealing a conduit, and a running adapter for setting the plug in the conduit in accordance with a first embodiment of the present invention.

Referring firstly to FIG. 1 there is shown a cut away side view of a plug, generally indicated by reference numeral 10 for sealing a conduit (not shown), and a running adapter 12 for setting the plug 10 in the conduit.

Figure 2:
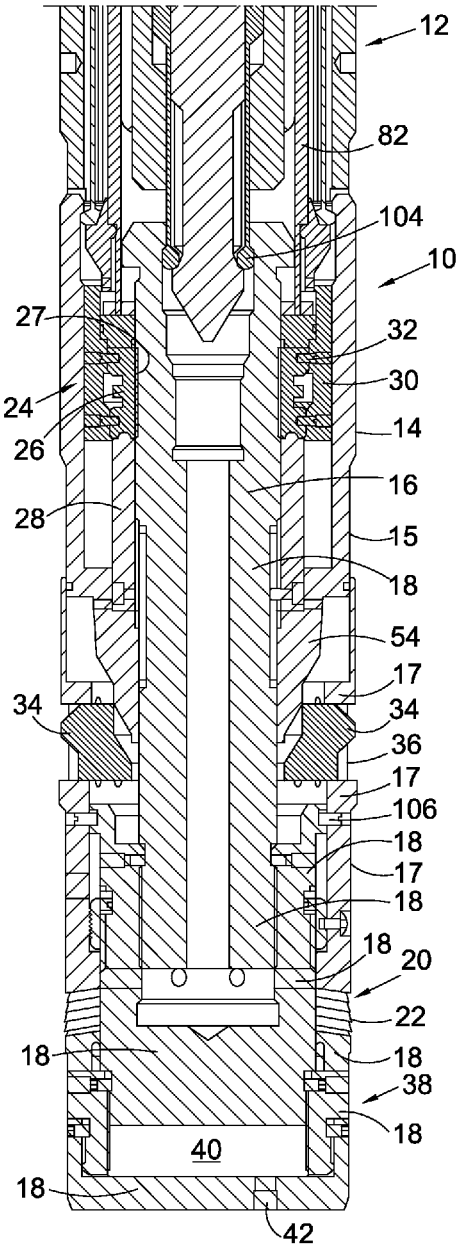
FIG. 2 is an enlarged cut away side view of section A of FIG. 1, showing the plug and part of the running adapter.
Figure 3:
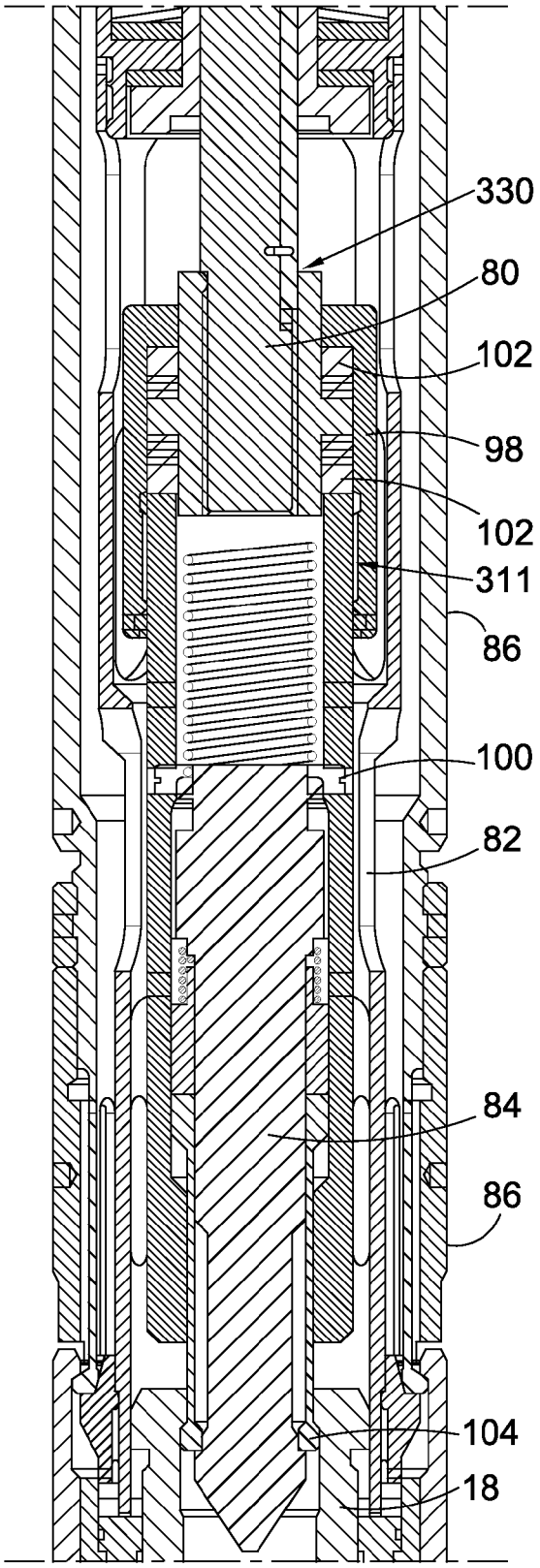
FIG. 3 is an enlarged cut away side view of section B of FIG. 1, showing part of the running adapter.
Figure 4:
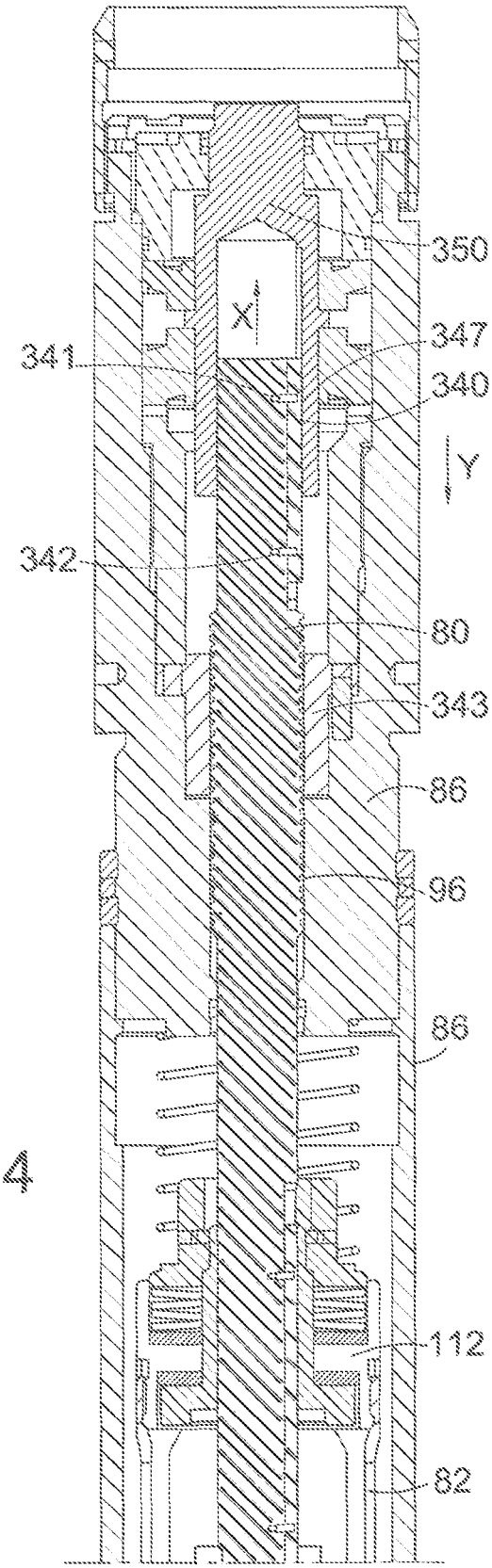
FIG. 4 is an enlarged cut away side view of section C of FIG. 1, showing part of the running adapter.

As can be seen from FIG. 1 the plug and running adapter 10,12 had been divided into three sections indicated as "A", "B", and "C", each of these sections is shown in FIGS. 2, 3 and 4 respectively.

Referring to FIG. 2, an enlarged cut away side view of section A of FIG. 1, showing the plug 10 and part of the running adapter 12.

The plug 10 includes a housing 14, divided in to a moveable upper housing section 15 and a fixed lower housing section 17. The plug 10 also includes a seal setting means 16 in the form of a plug mandrel 18 and a seal element 20 in the form of a stack of frusto-conical washers 22.

The plug 10 includes eight anchoring dogs 34 for anchoring the plug 10 in the conduit (not shown). The dogs 34 are axially restrained by the lower housing section 17 but are permitted to move radially outwards from the housing 14 through a series of openings 36.

The dogs 34 are moved radially outwards through the apertures 36 by the upper housing section 15, specifically, by the action of a housing ramp 54.

The plug 10 further comprises a seal and anchor locking means 24 comprising a locking nut 26, a spacer sleeve 28, and a retaining sleeve 30. The retaining sleeve 30 is releasably fixed to the locking nut 26 by means of a number of sheer screws 32, of which one is indicated. The locking nut 26 is attached to the plug mandrel 18 by a threaded connection 27, and the spacer sleeve acts on the housing upper portion 14, specifically the housing ramp 54. It will be understood that the spacer sleeve 28 could be part of the housing 14.

The seal and anchor locking means 24 permits movement of the housing upper portion 15 relative to the mandrel 18 in a setting direction, that is a direction which the seal element 20 is energised, but not in a releasing direction, opposite the setting direction.

Referring to FIGS. 3 and 4, enlarged cut away side views of sections B and C of FIG. 1 showing the running adapter 12, the adapter 12 is arranged, in use with the plug 10, to convert a rotary input force applied to an input mandrel 80 into a rotary and an axial output force for application to the plug 10. The rotary output force is applied to the locking nut 26 by a locking sleeve 82, and the axial output force is applied to the upper housing section 15 by a running adapter casing 86, and to the plug mandrel 18 by an output mandrel 84.

Figure 5:
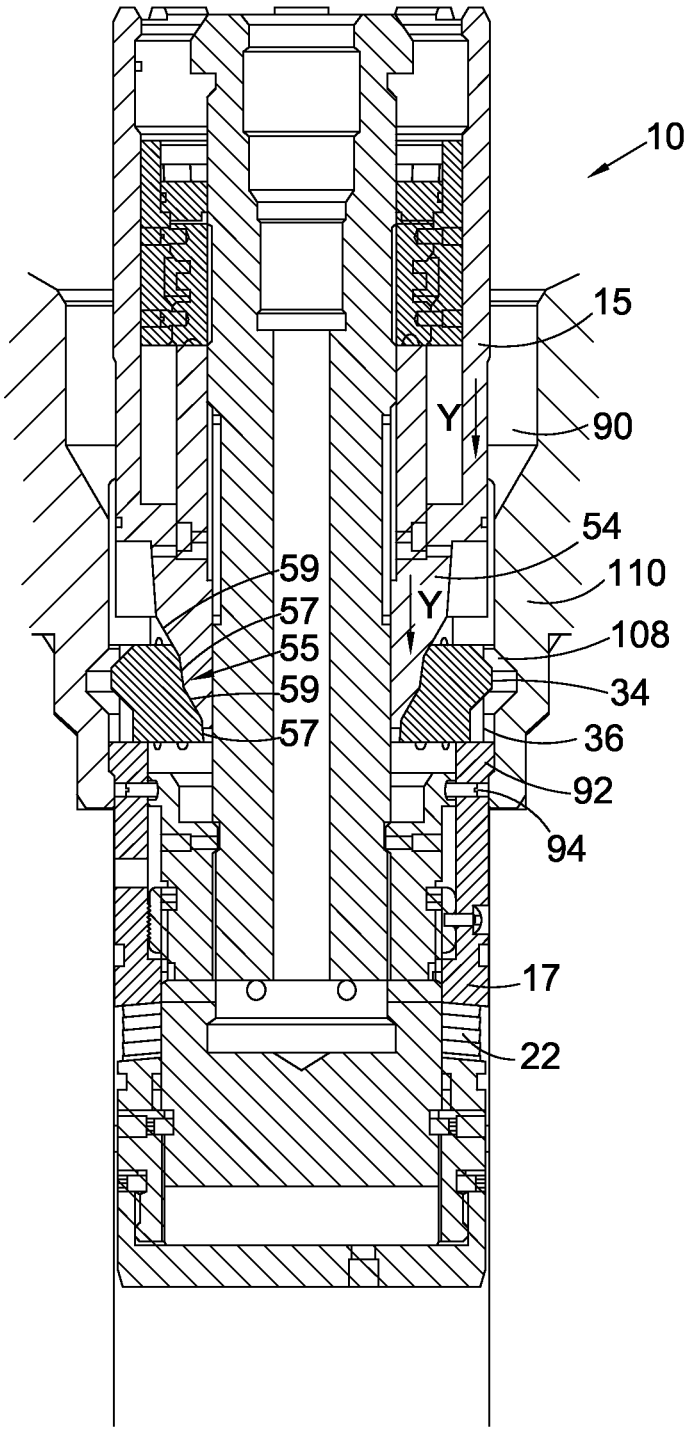
FIG. 5 is a cut away side view of the plug of FIG. 1 in a conduit prior to the anchoring dogs being set.
Figure 6:
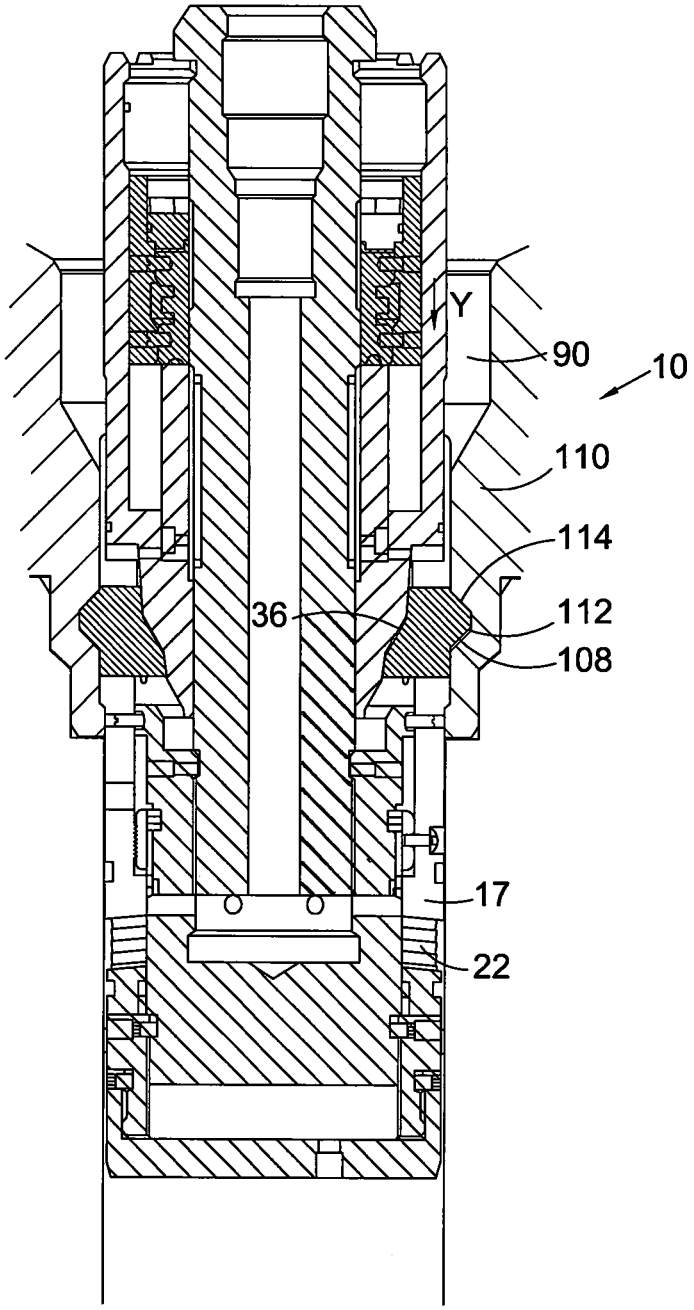
FIG. 6 is a cut away side view of the plug of FIG. 1 in the conduit after the anchoring dogs have been set and prior to the seal element being set.
Figure 7:
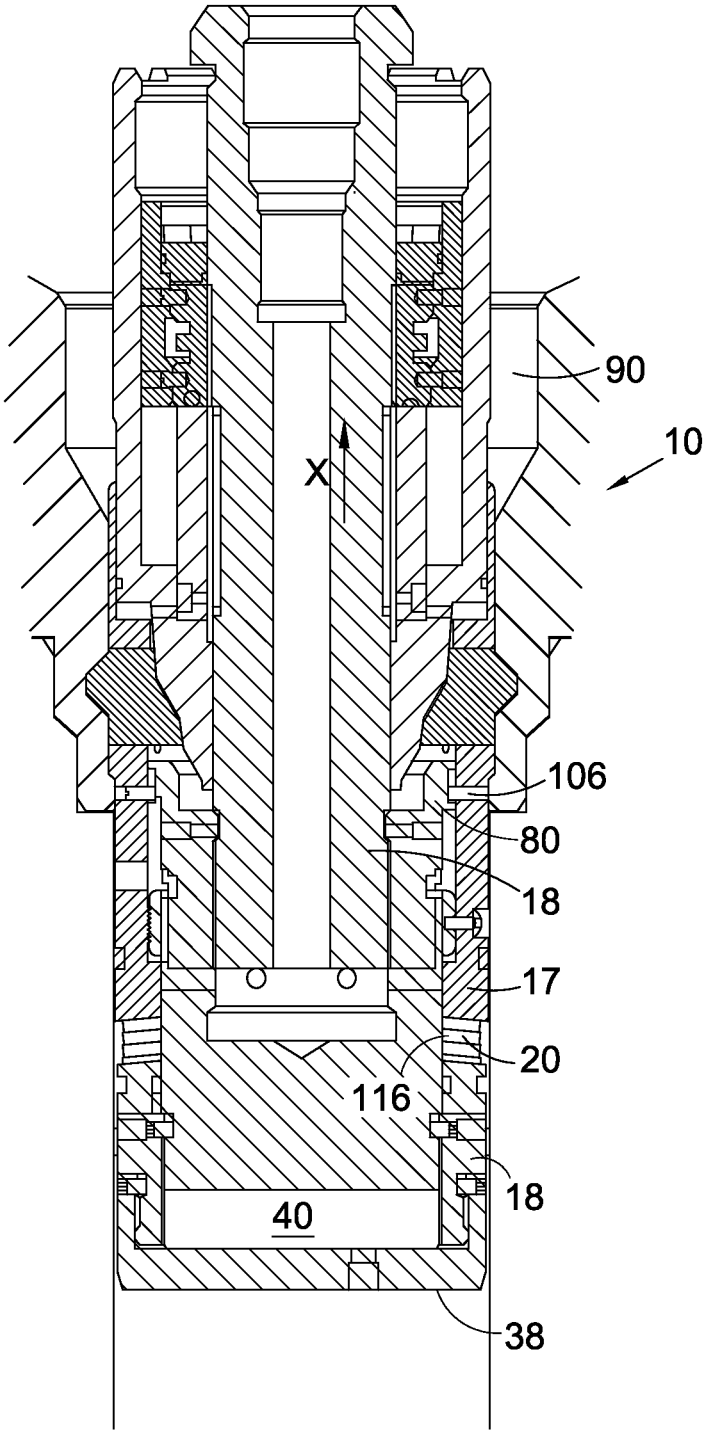
FIG. 7 is a cut away side view of the plug of FIG. 1 in the conduit after the anchoring dogs and the seal element have been set.

The setting of the plug 10, by the plug and the running adapter 12 will now be described with reference to FIGS. 1 to 4, and FIGS. 5 to 7. FIGS. 5 to 7 are cut-away views of the plug 10 being set in a conduit 90. For clarity, the running adapter 12 is not shown in any of FIGS. 5 to 7.

The plug and adapter 10,12 are lowered into the conduit 90, in this case the bore of a christmas tree. As can be seen from FIG. 5, the stack of washers 22 is arranged so that the washers 22 do not extend beyond the circumference housing lower section 17. This permits the plug 10 to be run in to the conduit 90 without damaging the seal element 20.

The plug 10 is run into the conduit 90 until a housing shoulder 92 engages a conduit no-go 94, indicating the plug 10 has reached the correct location. At this point the adapter 12 can be activated and the plug 10 can be set.

A rotary force is applied to the running adapter input mandrel 80 by an external drive (not shown) via an external drive connector 350. The external drive connector 350 is provided with a longitudinal slot 347. The slot 347 accepts a spline key 340 that is fixed to the input mandrel 80 by pins 342, 341. The running adapter input mandrel 80 has a threaded shaft to form a threaded connection 96 that engages a nut 343 within the running adaptor casing 96. The threaded connection 96 has a pitch of 0.2 inches. Also illustrated in FIG. 3 are key 330 and threaded connection 311.

The running adapter casing 86 is locked to a motorised setting tool (not shown) connected to the running adapter 12, preventing the casing 86 from rotating with the input mandrel 80. However linear axial movement of the running adapter casing 86 is permitted. The threaded connection 96 is arranged such that rotational movement of the input mandrel 80, in the absence of a resistance, would result in the input mandrel 80 moving the direction of arrow "X" (FIG. 4), applying a pulling force on the output mandrel 80, and the casing moving in the direction of arrow "Y", that is pushing on the upper housing section 15. When the mandrel 80 is prevented from uphole movement, the nut 343 and attached casing 86 moves downhole in direction Y.

There is however a resistance preventing the input mandrel 80 moving in the direction is arrow "X". The input mandrel 80 is connected to a collar 98 (FIG. 3), which is in turn connected to the output mandrel 84 via a number of shear screws 100. A pair of roller bearings 102 permit the input mandrel 80 to rotate within the collar 98 whilst still transmitting axial pulling forces, applied by the input mandrel 80, to the output mandrel 84. The output mandrel 84 is in turn connected to the plug mandrel 18 by means of a collet 104 (FIG. 2). The pulling force applied to the plug mandrel 18 by the input mandrel 80, via the collar 98 and the output mandrel 84 is resisted by a set of shear set screws 106.

The resistance of the shear set screws 106 prevents the input mandrel moving in the direction of arrow "X" and therefore the running adapter casing 86 moves in the direction of arrow "Y" and applies an axial "pushing" force on the upper housing section 15.

Referring to FIG. 5, a cut away side view of a plug 10 in a conduit 90 prior to the dogs 34 being set, under the action of this force, the upper housing section 15 and the housing ramp 54 move in the direction of arrow "Y", the ramp 54 engaging the dogs 34 and pushing them radially outwards through the housing apertures 36. The dogs 34 move towards engagement with a complementary recess 108 in the conduit wall 110. The ramp 54 defines a variable surface taper 55 having two sections 57 of shallow taper and two sections 59 of steep taper. The steep taper sections 59 are arranged to move the dogs 34 rapidly towards the conduit recess 108, with the shallow taper sections 57 pushing the dogs 34 for the final stage of their travel into the recess 108 and into engagement with the conduit wall 110. A shallow taper for the stage of the travel in which actual engagement occurs is preferred because a shallow taper maximises the radial force applied to the dogs 34 and assists in locking the plug 10 in the conduit 90. Utilising the steep taper sections 59 for the initial expansion of the travel reduces the axial length of the ramp 54.

The movement of the upper housing section 15 relative to the plug mandrel 18 is taken up by the locking nut 26, which engages the plug mandrel 18 by means of the threaded connection 27. As the upper housing section 15 moves relative to the plug mandrel 18, the locking nut 26 is rotated by the running adapter locking sleeve 82 relative to the spacer sleeve 28 via the interlocking castellations 360 provided on the nut 26 and the sleeve 82. This rotation is unidirectional preventing relative movement of the mandrel 18 with respect to the upper housing section 15 in the opposite direction, which, if permitted, would release the seal element 20.

The locking sleeve 82 is connected to the input mandrel 80 by a clutch 112 (FIG. 4). As the input mandrel 80 rotates the locking sleeve 82 rotates, however if the locking sleeve 82 encounters sufficient resistance, the clutch 112 slips and the rotation of the locking sleeve 82 stops. The pitch of the threaded connection 27 between the locking nut 26 and the plug mandrel 18 is 0.25 inches, compared to the pitch of the threaded connection between the input mandrel 80 and the adapter casing 86 of 0.2 inches. This difference in the two pitches means that for every revolution of the input mandrel 18, the adapter casing 86, and hence the upper housing section, will move 0.2 inches, and the locking nut will move 0.25 inches. However as the locking nut 26 is acts on upper housing section 15 via the spacer sleeve 28, the full movement of the locking nut 26 per revolution of the input mandrel 18 is not permitted and sufficient resistance is generated on the locking sleeve 82 to slip the clutch 112.

The locking sleeve 82, however, applies a continual rotational force to the locking nut 26 and as soon as there is further movement of the upper housing section 15 relative to the plug mandrel 18, the locking nut 26 will take up this movement.

Figure 11:
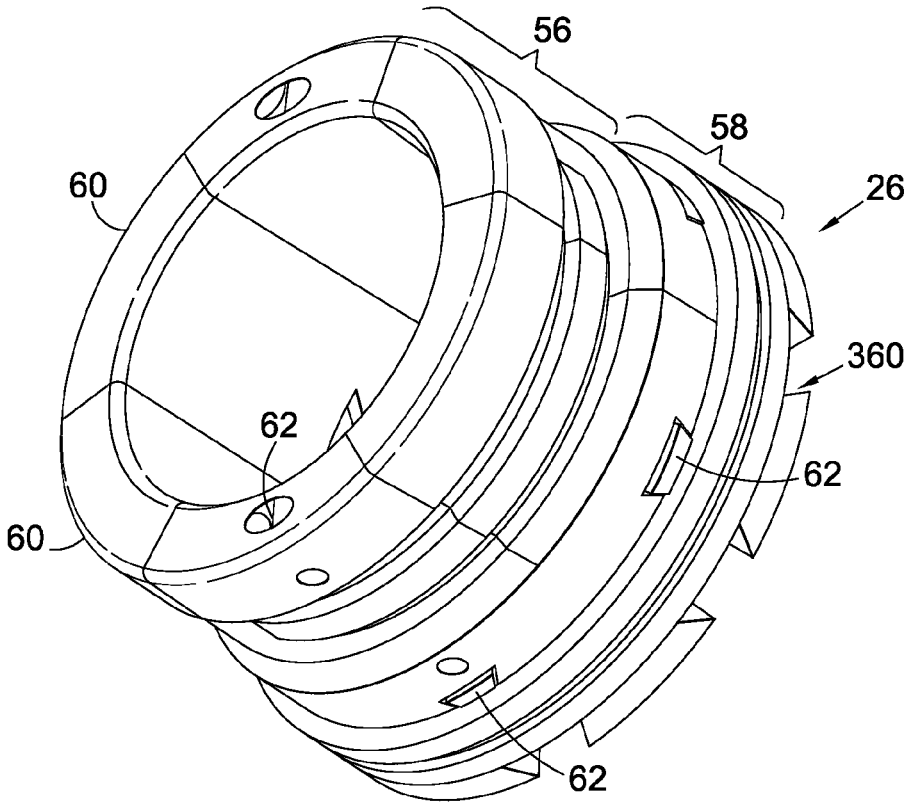
FIG. 11 is a perspective view of a locking nut.

Referring now to FIG. 11, a perspective view of the locking nut 26, it can be seen the locking nut comprises a first locking nut portion 56 and a second locking nut portion 58. The first locking nut portion 56 comprises six axial sections 60, each axial section 60 being attached to the second locking nut portion 58 by means of a dovetail connection 62. The internal surfaces 61 of the six axial sections 60, when assembled, define one half of the threaded connection 27. The dovetail connections 62 permit the axial sections 60 to move in a radial direction relative to the second locking nut portion 58 but not in an axial direction.

When the seal locking means 24 is assembled the axial sections 60 are prevented from moving radially outwards by the retaining sleeve 30.

Figure 12:
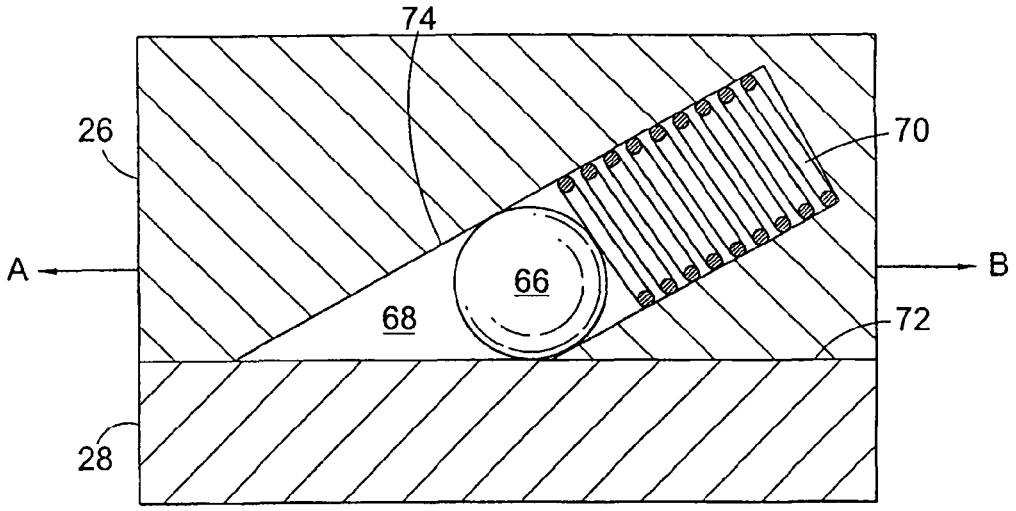
FIG. 12 is a representation of part of the locking nut.

The locking nut 26 also includes unidirectional locking device 64. The arrangement of each locking device 64 can be seen more clearly in FIG. 12. Each locking device 64 comprises a ball bearing 66 located in a channel 68 having an internal surface 74. The ball bearing 66 is mounted on a spring 70 which pushes against the ball bearing 66, forcing the ball bearing 66 out of the channel 68.

As the locking nut 26 rotates with respect to the spacer sleeve 28, the ball bearing 66 is pressed against the spacer sleeve surface 72. If the locking nut 26 is moving relative to the spacer sleeve 28 in the direction of arrow "A", the ball bearing is pushed back up the channel 68, however if a force is applied to the locking nut 26 in the direction of arrow "B", then the ball bearing 66 is drawn out of the channel 68 and wedges between the sleeve surface 72 and the channel surface 74, preventing further movement in the direction of arrow "B". As the interface between the locking nut 26 and the spacer sleeve 28 is located on an arc centred on, and substantially perpendicular to, the longitudinal axis of the adapter, backlash is minimised. For example if the locking nut moved 1/20 of a revolution in the direction of arrow "B", this would result in axial movement in the release direction of (0.25×1/20) inches, that is 0.0125 inches. The motorised setting tool (not shown) records the torque versus turn profile of the locking nut 26. This information is transmitted live by e-line (not shown) from the adapter 12 and compared with the expected profile in order to confirm proper setting of the plug.

Referring now to FIG. 6, a cut away side view of the plug 10 in the conduit 90 after the anchoring dogs 34 have been set and prior to the seal element 20 being set, the dogs 34 have engaged the recess 108, particularly, a first dog surface region 112 has engaged a first recess surface region 114. This arrangement imparts a downward force on the plug 10 which is resisted by the interaction between the plug shoulder 92 and the conduit no-go 94, with the result that the plug 10 is firmly locked in the conduit 90. With the dogs 34 fully set, the upper housing section 15 can not move any further in the direction of arrow "Y".

Once the plug 10 is firmly locked in position, the seal element 20 can be set. This is achieved by increasing the rotary force on the input mandrel 80.

Referring to FIG. 7, a cut away side view of the plug 10 in the conduit 90 after the anchoring dogs and the seal element 20 have been set, the force is increased on the input mandrel 80 until the shear screws 106 shear, permitting the input mandrel 80, and hence the plug mandrel 18, to move in the direction of arrow "X".

The seal element 20 is located in a seal recess 116 defined by the plug mandrel 18 and the lower housing section 17. As the plug mandrel 18 moves upwards, that is in the direction of arrow "X", the seal recess 116 reduces in size, compressing the seal element 20 into engagement with the conduit 90.

The movement of the plug mandrel 18 relative to the housing 14 is taken up by the locking nut 26, which is driven by the running adapter locking sleeve 82, in the same way as described previously.

Figure 13:
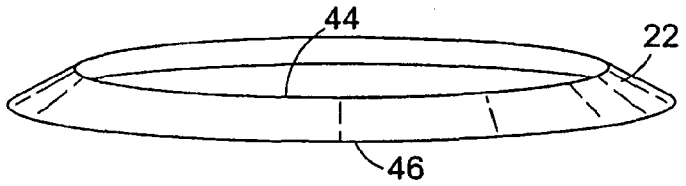
FIG. 13 is a perspective view of one of the first conical washers of the seal element.

As discussed earlier, the seal element 20 is a stack of frusto-conical washers 22. Referring to FIG. 13 there is shown a perspective view of one of the first conical washers 22. Each frusto-conical washer 22 is made from Inconel steel and coated in a layer of silver 35 microns thick. The washer inner edge 44 defines an aperture through which the plug mandrel 18 passes and when the seal is set this inner edge 44 is adapted to sealingly engage the mandrel 18. The outer washer edge 46, when the seal element 20 is energised, is adapted to form a seal with a conduit, each washer 22 in the stack forming an independent seal from every other washer 22.

Figure 14:
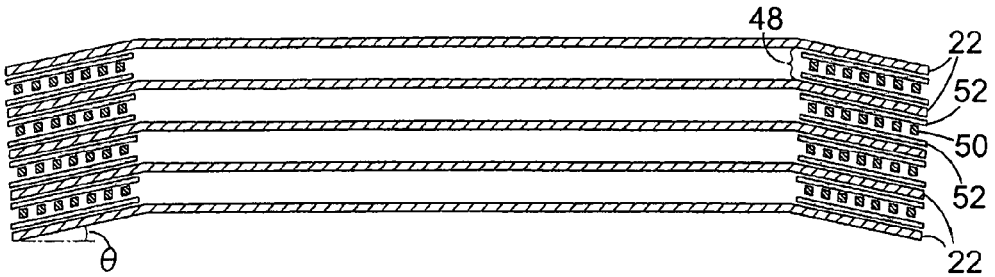
FIG. 14 is a schematic cut away side view of part of a stack of frusto-conical washers in an uncompressed configuration.
Figure 15:
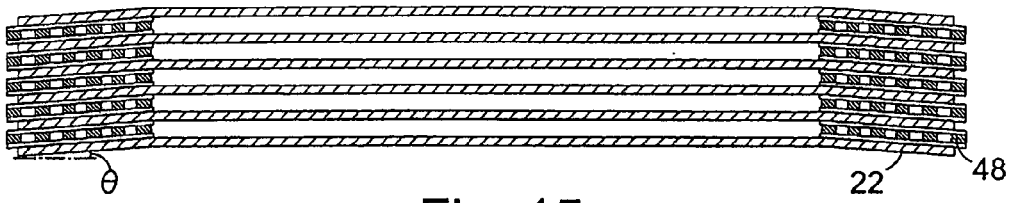
FIG. 15 is a schematic cut away side view of part of a stack of frusto-conical washers in an compressed configuration.

As can be seen from FIG. 14, a schematic cut away side view of part of a stack of frusto-conical washers 22 in an uncompressed configuration, between each washer 22 there is a laminate of softer material 48. This laminate 48 is made up of a central layer 50 of PEEK sandwiched between two layers 52 of PTFE. As the stack of washers 22 is energised, by being compressed by relative movement between the housing 14 and the plug mandrel 18, the laminate 48 is squeezed radially inwards, forming a seal with the plug mandrel 18, and radially outwards, forming a seal with the conduit 90. FIG. 15 shows a schematic cut away side view of part of a stack of frusto-conical washers 22 in a compressed, or set, configuration As can be seen from FIG. 15 the laminate of softer material 48 is squeezed beyond the edges of the washers 22, and assists in forming a seal if the conduit 90 is not entirely smooth; the softer material spreading into any voids or inconsistencies in the surface of the conduit 90.

It will be noted from FIG. 15 that even when fully compressed each washer 22 is not completely flattened. In the uncompressed state the angle of each washer to the horizontal, indicated as angle θ on FIGS. 14 and 15, is 8° to the horizontal. In the compressed, or set, configuration angle θ is 5°. The retention of a slight angle to the horizontal assists the seal element in recovering back to the uncompressed configuration when the compression force is removed.

Referring back to FIG. 7, in the leading end 38 of the plug 10 is a reservoir 40. The reservoir 40 is sealed from the surrounding environment and contains a body of air at a pressure of 1 bar. A reservoir cap 42 is provided which seals the reservoir 40 and is adapted to rupture at a given threshold pressure. The purpose of the reservoir 40 is to reduce pressure on the seal element 20 in the event that a volume of air becomes trapped and pressurised below the plug 10. A volume of air may get trapped if, for example, it is decided to set two plugs 10 in series.

Without the reservoir 40, the increased pressure would apply a force on the plug 10 which may affect the integrity of the seal element 20. With the reservoir 40, before any damage can be done to the integrity of the seal, the cap 42 ruptures, with the effect of reducing the overall pressure of the air trapped below the plug 10.

FIGS. 5 to 7 explained the setting of the plug 10 in the conduit 90, the releasing and retrieval of the plug will now be described with reference to FIGS. 1 to 4 and FIGS. 8 to 10. The releasing and retrieval of the plug 10 is achieved using conventional wireline techniques The plug 10 is prevented from being removed from the conduit 90 by the locking means 24, particularly because the plug mandrel 18 can not move in the release direction relative to the housing 14. As previously discussed the locking nut 26 comprises a first portion 56 and a second portion 58, the first portion 56 comprising six radially moveable sections 60, which together define one half of the threaded connection 27 between the locking nut 26 and the plug mandrel 18. The retaining sleeve 30 prevents radial movement of the locking nut sections 26.

Figure 8:
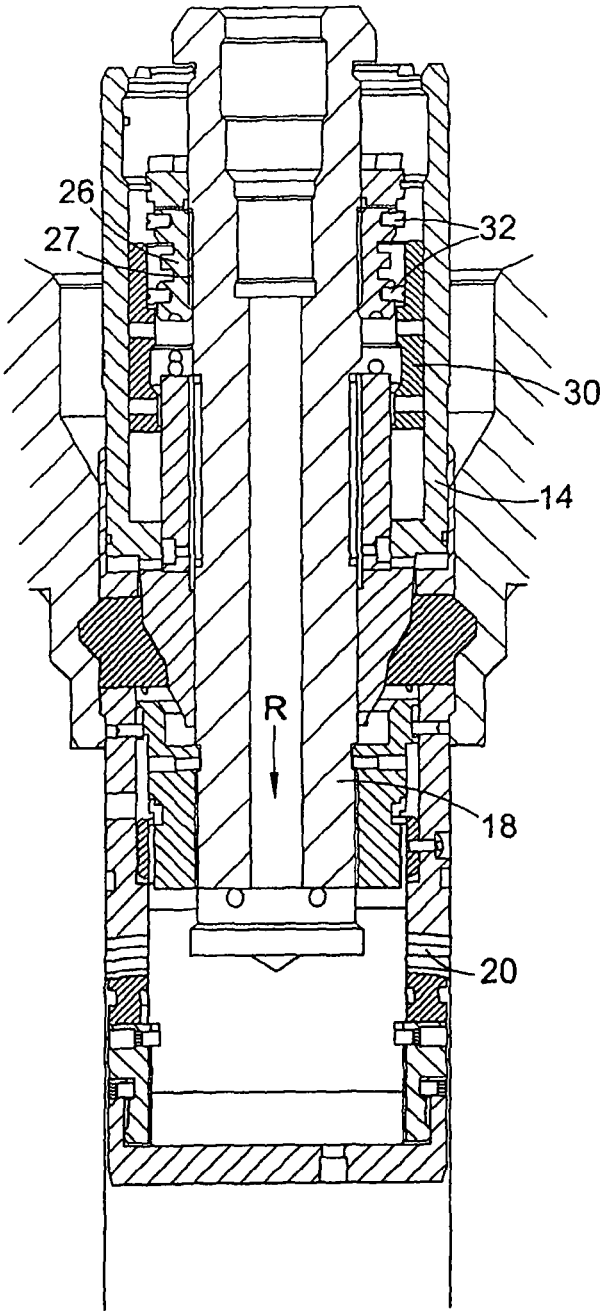
FIG. 8 is a cut away side view of the plug of FIG. 1 in the conduit showing the retaining sleeve disengaged from the locking nut.

Referring to FIG. 8, a cut away side view of the plug 10 in the conduit 90 showing the retaining sleeve 30 disengaged from the locking nut 26, sufficient force has been applied to the retaining sleeve 30 by a wireline controlled releasing tool (not shown) to overcome the shear screws 32 so the shear screws 32 are no longer securing the retaining sleeve 30 to the locking nut 26, permitting the six moveable sections 60 to move radially outwardly and break the threaded connection 27 between the locking nut 26 and the plug mandrel 18.

As the plug mandrel 18 is no longer locked relative to the housing 14, the wireline controlled releasing tool can apply a force to the plug mandrel 18 to move the plug mandrel 18 in the release direction, that is in the direction of arrow "R" on FIG. 8.

As the plug mandrel 18 moves in the direction of arrow "R", the compression force on the seal element 20 is removed and the seals are permitted to spring back to the uncompressed configuration, releasing the pressure below the seal element 20.

Figure 9:
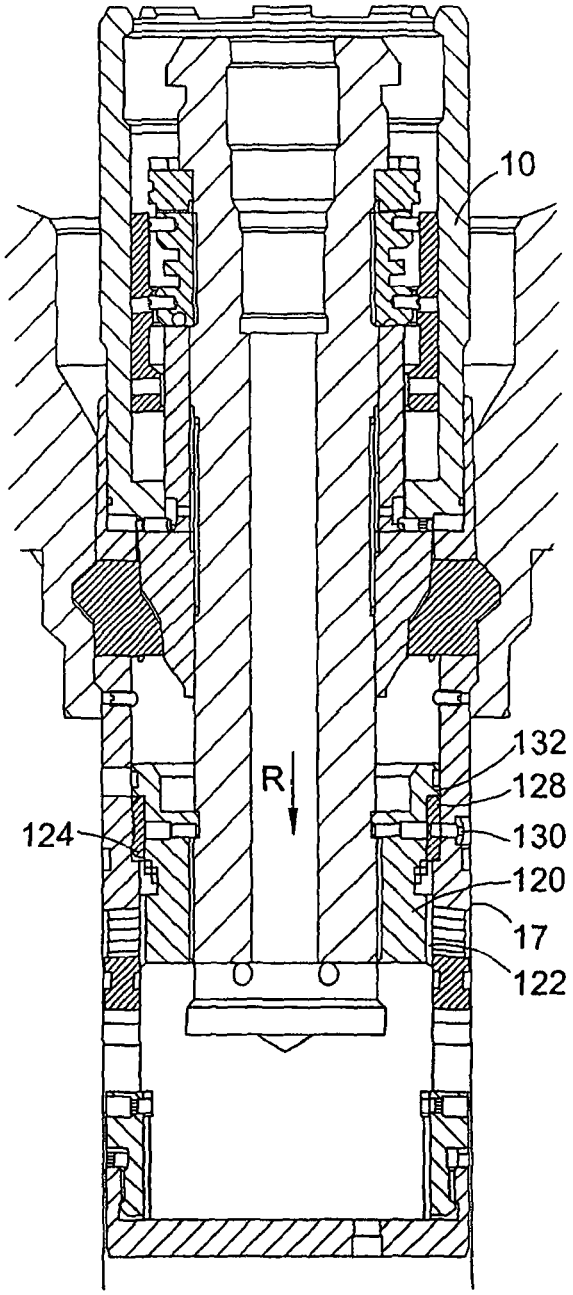
FIG. 9 is a cut away side view of the plug of FIG. 1 in the conduit showing the seal element released.
Figure 16:
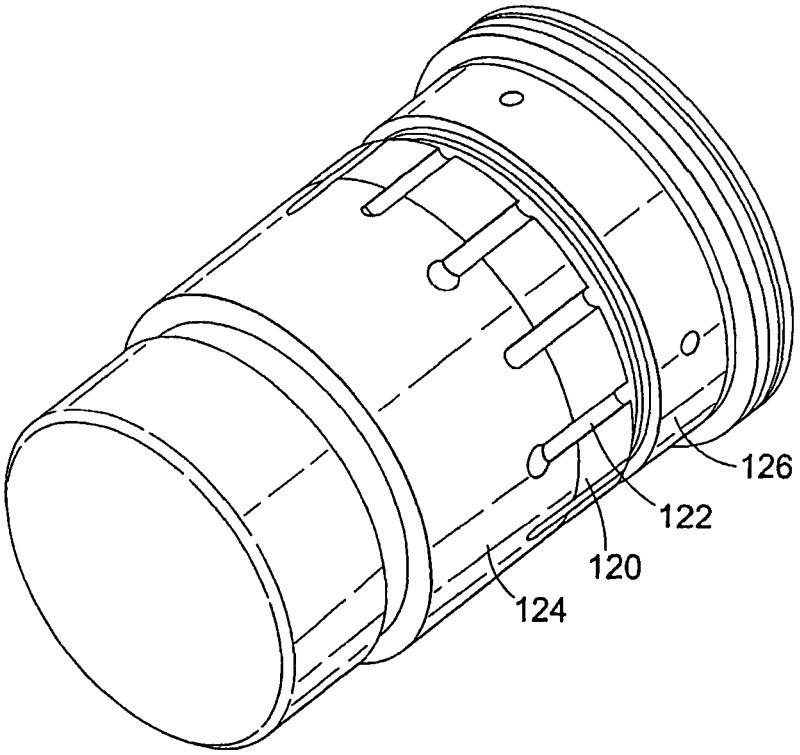
FIG. 16 is a perspective view of part of the plug mandrel.

Referring to FIG. 9, a cut away side view of the plug 10 in the conduit 90 showing the seal element 20 released, the plug mandrel 18 includes a grooved section 120 describing a number of grooves 122. The grooves 122 can be seen more clearly on FIG. 16, a perspective view of part of the plug mandrel 18. When the seal element 20 is set, the inner edge 44 of each washer 22 engages a non-grooved section 124 of the plug mandrel 18, however as the plug mandrel 18 moves in the release direction the grooved section 122 is translates behind the seal element 20, and a pressure equalising flow path is created around the seal element 20.

To ensure the seal element 20 does not re-set, the plug mandrel 18 is also provided with a wickered surface 126 (FIGS. 9 and 16) which engages with a complementary wickered element 128 (FIG. 9), which is secured to the lower housing section 17 by a screw 130. The engagement between the wickered surface 126 and the wickered element 128 is arranged to permit only uni-directional movement, thereby preventing the plug mandrel 18 moving and resetting the seal element 20. The plug mandrel 18 is moved in the direction arrow "R" until the plug mandrel lug 132 engages the wickered element 128, preventing further movement of the plug mandrel 18.

With the seal between the plug 10 and the conduit 90 broken, the plug 10 can be safely removed from the conduit 90, because the seal element 20 has been de-energised and pressure equalisation has occurred across the seal element 20. The pressure equalisation prevents the possibility of the plug being blown up the conduit 90 by pressure trapped below the plug 10. The wireline releasing tool is recovered to surface and a wireline pulling tool (not shown) is sent down to the plug 10 to engage the plug housing 14.

Figure 10:
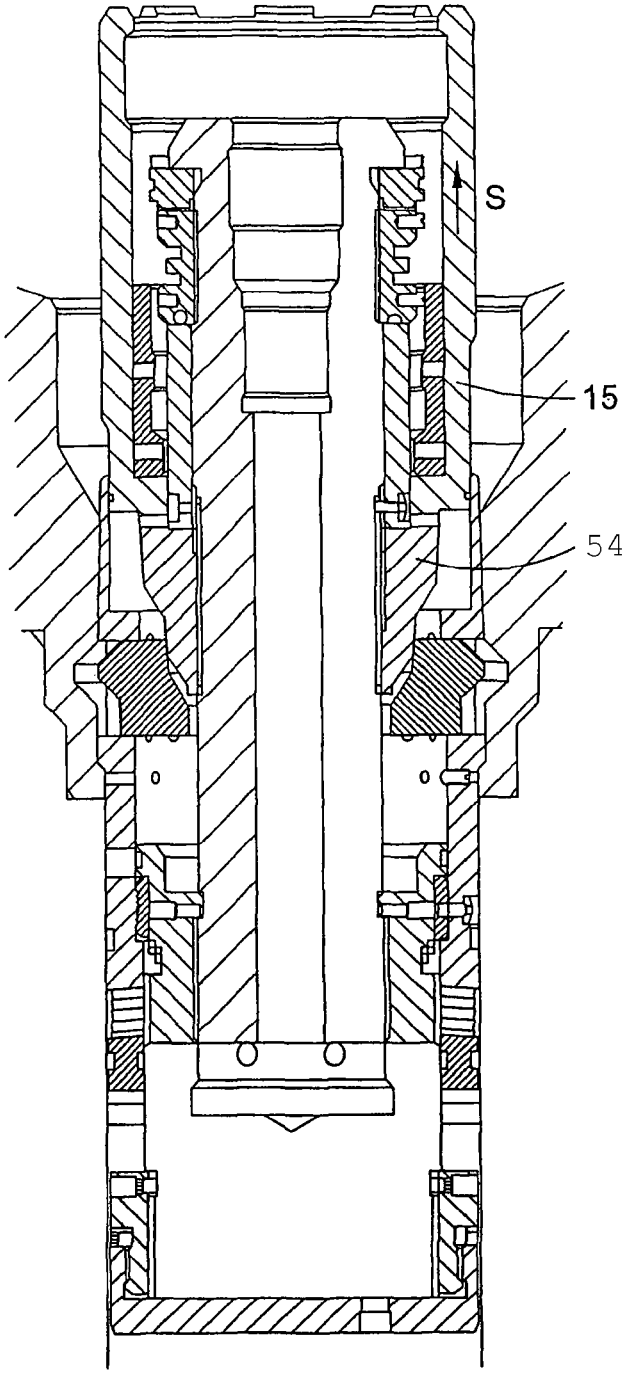
FIG. 10 is a cut away side view of the plug of FIG. 1 in the conduit showing the anchoring dogs released.

Referring to FIG. 10, a cut away side view of the plug 10 in the conduit 90 showing the anchoring dogs 34 released. As the input mandrel 18 can not now move relative to the housing 14, the upper housing section 15 moves in the direction of arrow "S" under the action of the wireline pulling tool. The housing ramp 54 moves away from the dogs 34 permitting the dogs 34 to retract into the housing 14 through the housing apertures 36.

The plug 10 is now released from the conduit 90 and can be recovered to surface by the wireline pulling tool.

A second embodiment of the present invention will now be described with reference to FIGS. 17-23.

Figure 17:
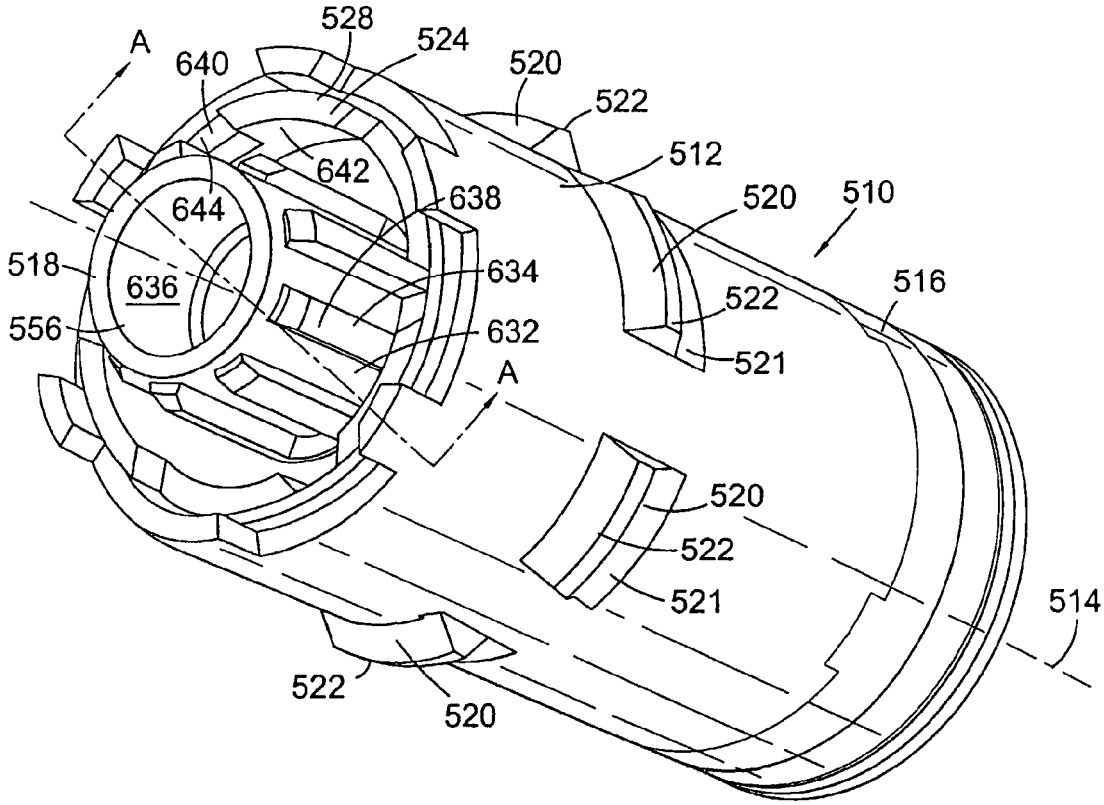
FIG. 17 is a perspective view of a plug for sealing a conduit in accordance with a second embodiment of the present invention.

Referring firstly to FIG. 17, there is shown a perspective view of a plug, generally indicated by reference numeral 510, for sealing a conduit in accordance with a second embodiment of the present invention. The plug 510 comprises a housing 512 having a longitudinal axis 514. The plug 510 further includes a plurality of seal elements 516 for creating a seal between the plug 510 and the conduit (not shown). Within the housing 512 is a seal setting means 518 for setting the plurality of seal elements 516 by rotationally translating the seal setting means 518 with respect to the housing 512 such that the plurality of seal elements 516 are compressed into a sealing engagement with the conduit (not shown). The plug further includes an anchoring system 520 for securing the plug 10 in the conduit (not shown). The anchoring system 520 includes a dog expander ramp 528 (shown and discussed in connection with FIG. 18) and a plurality of dogs 522. The anchoring system 520 is set by anchor setting means 524. Rotation of the anchor setting means 524 with respect to the housing 512 translates the anchor setting means 524 with respect to the housing 512 and forces the dogs 522, through the dog expander ramp 528, into engagement with recesses in the conduit (not shown).

Figure 18:
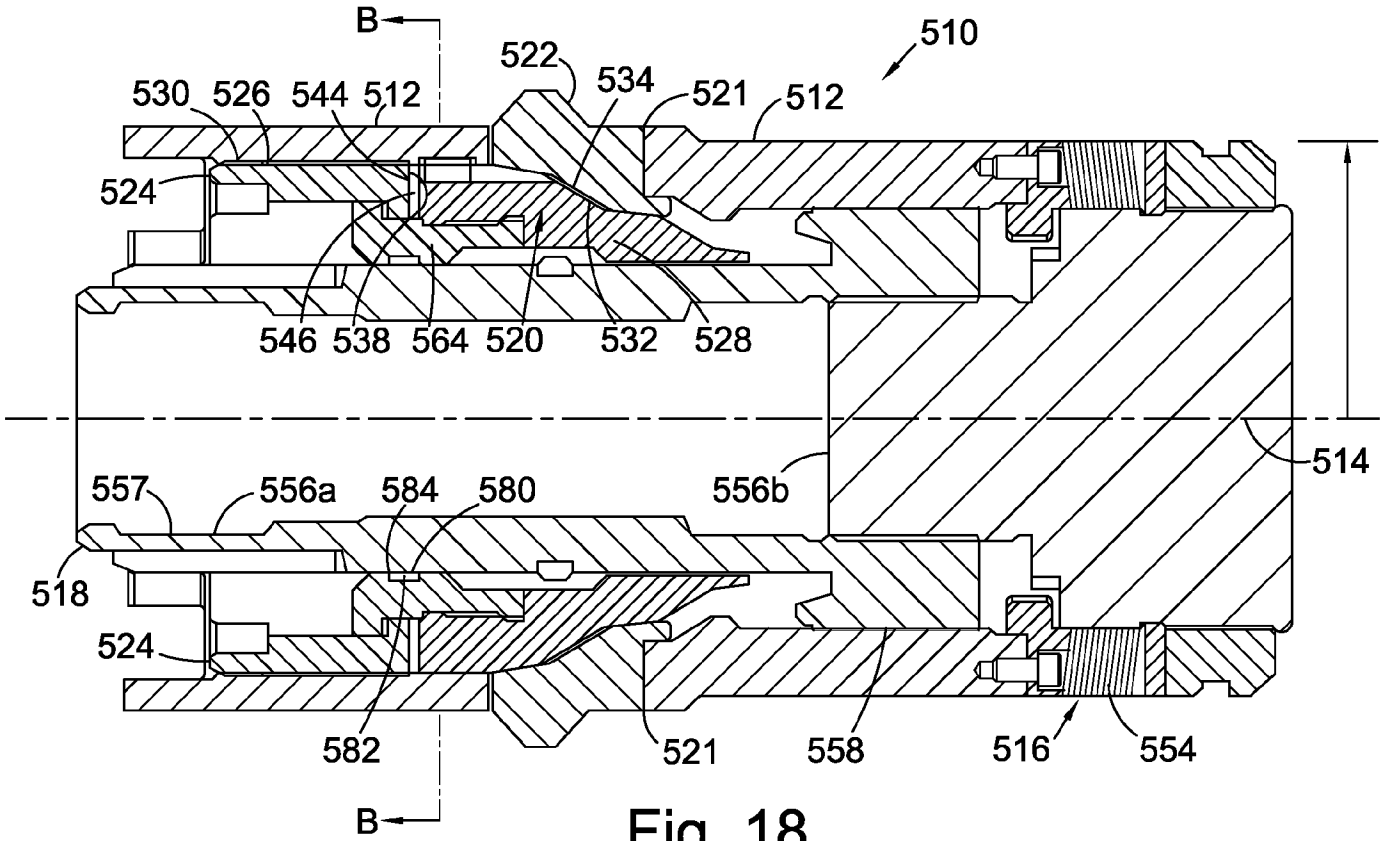
FIG. 18 is a sectional view of the plug of FIG. 1 taken through line A-A on FIG. 17.

These and additional elements of the plug 510 can be seen on FIG. 18, a sectional view of the plug 510 taken through line A-A on FIG. 17. As can be seen from FIG. 18, the anchor setting means 524 comprises a dog nut 526, the anchoring system 520 comprises six dogs 522 and the housing 512 further comprises a dog expander ramp 528. The dog nut 526 engages the housing 12 by means of a threaded connection 530. As the dog nut 526 is rotated it translates to the right of FIG. 18. This translation acts on the dog expander ramp 528 which also moves to the right. The dog expander ramp 528 includes a leading surface 532 which engages a back surface 534 of the dogs 522. Co-operation between the dog expander ramp leading surface 532 and the dog back surface 534 causes the dogs 522 to move outwards from the plug 510, through apertures 521 in the housing 512, in a direction perpendicular to the longitudinal axis 514.

Figure 19:
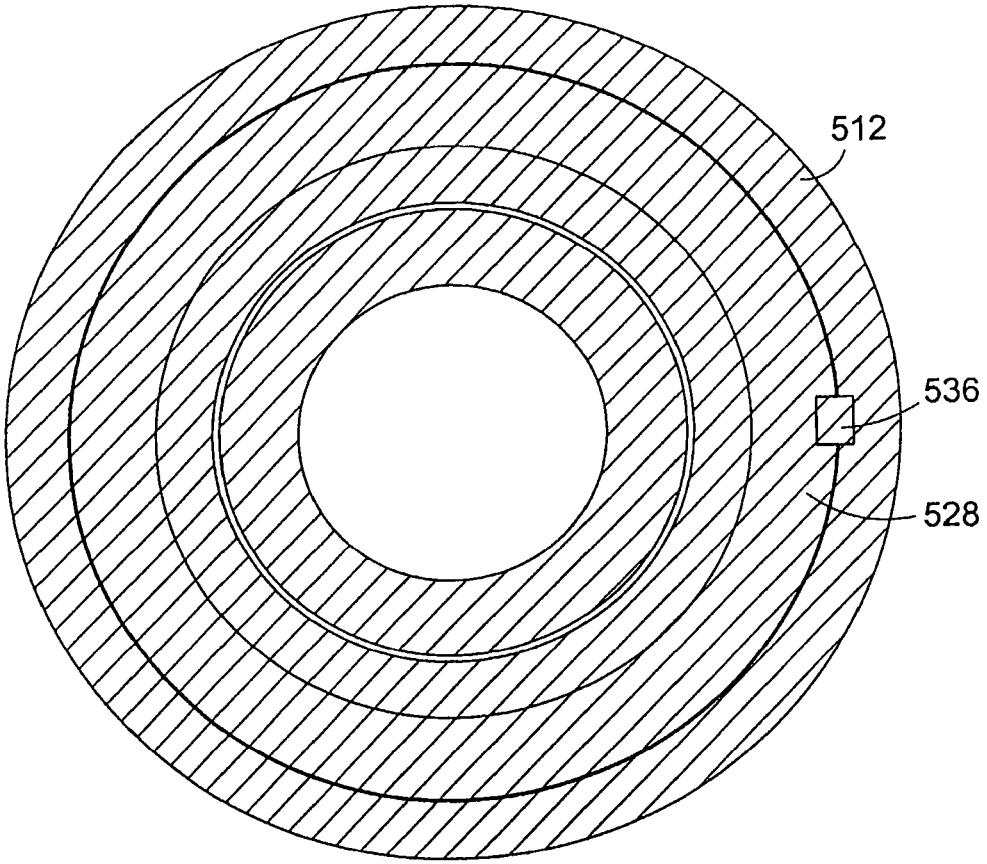
FIG. 19 is a sectional view taken through line B-B on FIG. 18.

Referring now to FIG. 19, there is shown a sectional view through line B-B from FIG. 18. This shows that the dog expander ramp 528 is rotationally fixed to the housing 512 by means of a key 536. Therefore as the dog expander ramp 528 translates to the right it does not rotate.

Referring back to FIG. 18, the plug 510 further includes an anchor ratchet 538. The anchor ratchet 538 comprises a set of teeth or serrations (not shown) in the form of a buttress, located on an end surface 544 of the anchor setting means 524 in the form of a dog nut and three complementary anchor ratchet tangs (not shown on FIG. 18) located on a first rotary lock ring 546 pinned to the dog expander ramp 520. The engagement of the tangs and the teeth or serrations allows rotation in one direction but not the other as the tang prevents rotation in the opposite direction because it would lock against the buttress.

Figure 20C:
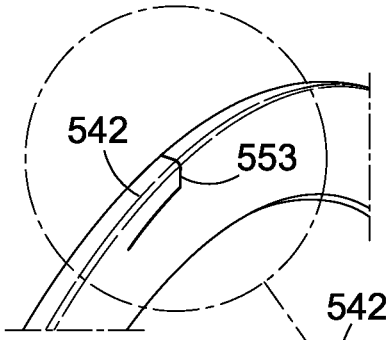
FIG. 20*c* is an enlarged view of part of the first rotary lock ring of FIG. 20*a*.
Figure 20A:
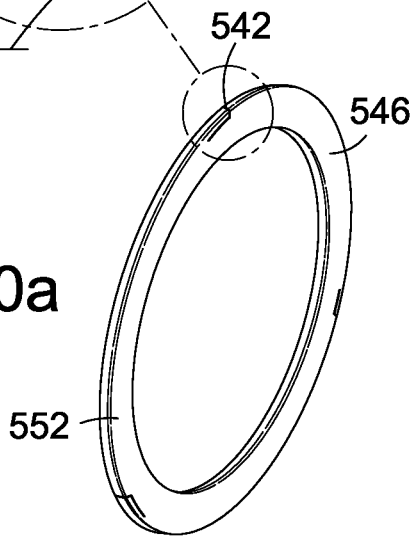
FIG. 20*a* is a perspective view of the first rotary lock ring of FIG. 18.
Figure 20B:
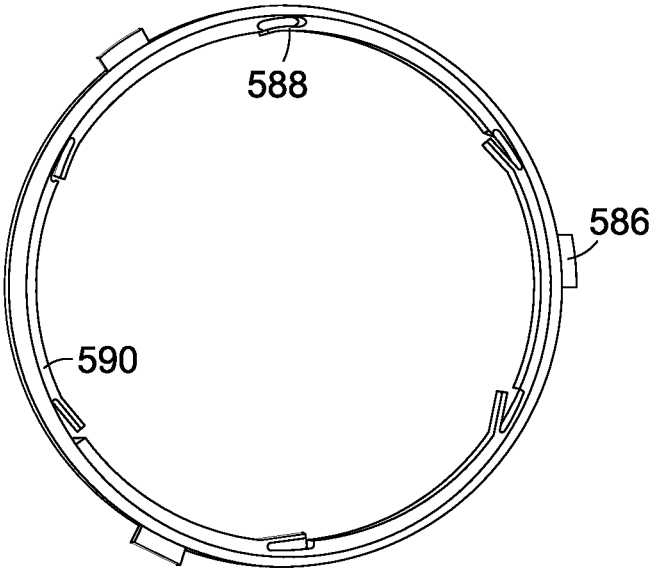
FIG. 20*b* is a plan view of the second rotary lock ring of FIG. 18.

The first rotary lock ring 546 can be best seen in FIG. 20*a* and FIG. 20*c*, a perspective view of the first rotary lock ring 546. The first rotary lock ring 546 comprises three tangs 542 located on, and sitting proud of, an external surface 552 of the first rotary lock ring 546. One of the tangs is also shown in enlarged detail on FIG. 20*a*. The tangs 542 are machined into the first rotary lock ring 546, and are bent outwards such that edge 553 forms a ratchet with the serrated face 544 of a dog nut.

The first rotary lock ring 546 is centred on the longitudinal axis 514 of the plug 10 such that the anchor ratchet 538 is arranged along an arc centred on, and substantially perpendicular to the longitudinal axis 514.

Referring back to FIG. 18, the plurality of seal elements 516 comprises a stack of fifteen frusto-conical washers 554. Frusto-conical washers 554 are used because a high expansion ratio is achievable by compression of a frusto-conical washer permitting the plug 510 to be run into position within a conduit without building up a significant head of pressure in front of the plug 510. The plug 510 is set by seal setting means 518 which comprises a two-part mandrel 556*a,b*. The mandrel 556*a,b* is connected to the housing 512 by means of a threaded connection 558. The threaded connection 558 is such that if the seal setting means 518 is rotated it translates to the left of FIG. 17, travelling along the threaded connection 558. This motion compresses the frusto-conical washers 554 increasing the radius 560 defined by the frusto-conical washers 554 from the longitudinal axis 514. As they expand, the frusto-conical washers 554 engage the wall of a conduit (not shown) and form a seal with the conduit.

Over compression of the frusto-conical washers 554 is prevented by stop 562 engaging with housing no-go 564.

The plug 510 further includes a seal ratchet 580. The seal ratchet 580 comprises a set of teeth (not shown) located on an external surface 582 of the mandrel 556 and six complementary seal ratchet tangs (not shown on FIG. 18) located on a second rotary lock ring 584. The second rotary lock ring 584 can be best seen in FIG. 20*b*, a plan view of the second rotary lock ring 584. The second rotary lock ring 584 is secured to the housing no-go 564 by lugs 586. The second rotary lock ring 584 comprises six tangs 588 located on, and sitting proud of, an internal surface 590 of the second rotary lock ring 584.

The second rotary lock ring 584 is centred on the longitudinal axis 514 of the plug 510 such that the seal ratchet 580 is arranged along an arc centred on, and substantially perpendicular to the longitudinal axis 514.

The setting of the plug 510 is a two stage process because the plug 510 is arranged such that rotation in one direction (here after referred to as direction X) will drive the dog nut 526 and set the dogs 522 in a conduit recess, and rotation in the opposite direction (hereafter referred to as direction Y) will drive the mandrel 556 and set the sealing element 516.

Figure 21:
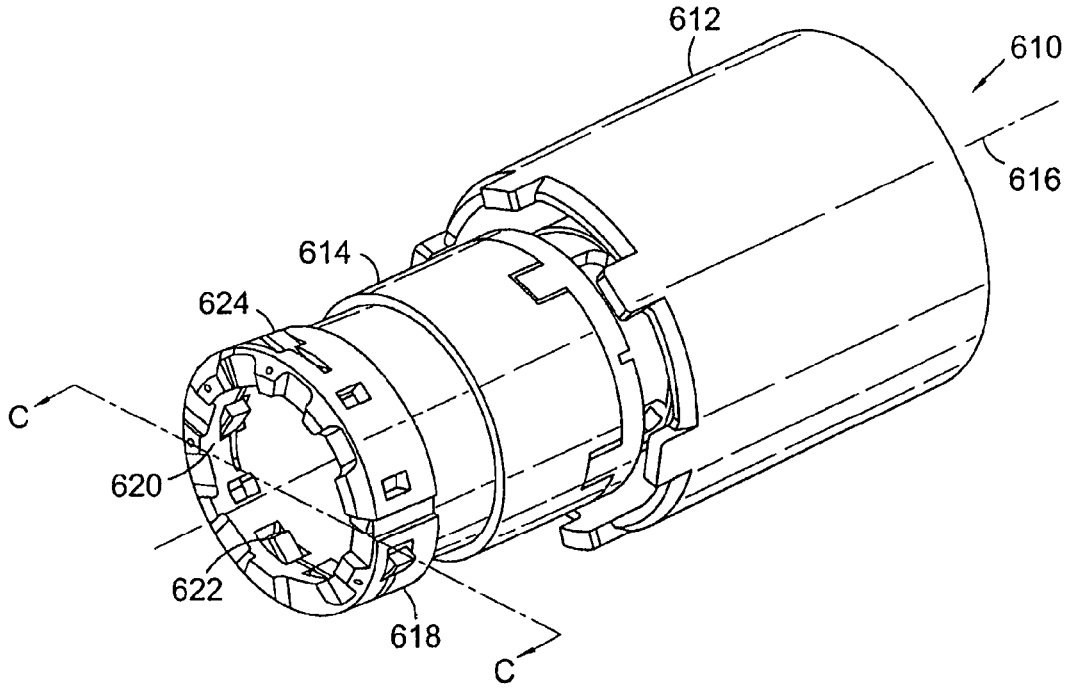
FIG. 21 is a perspective view of a plug running adapter for setting a plug in a conduit in accordance with a second embodiment of the present invention.

Referring now to FIG. 21, there is shown a perspective view of a plug running adapter generally indicated by reference numeral 610 for setting the plug 510 in a conduit in accordance with a second embodiment of the present invention. The plug running adapter includes a housing 612, and a tubular member 614 extending from the housing 612. The tubular member 614 has a longitudinal axis 616, an outer surface 618 and an inner surface 620. The outer surface 618 is adapted to engage the anchor setting means 524 of the plug 510 and the inner surface 620 is adapted to engage the seal setting means 518 of the plug 510.

Figure 22:
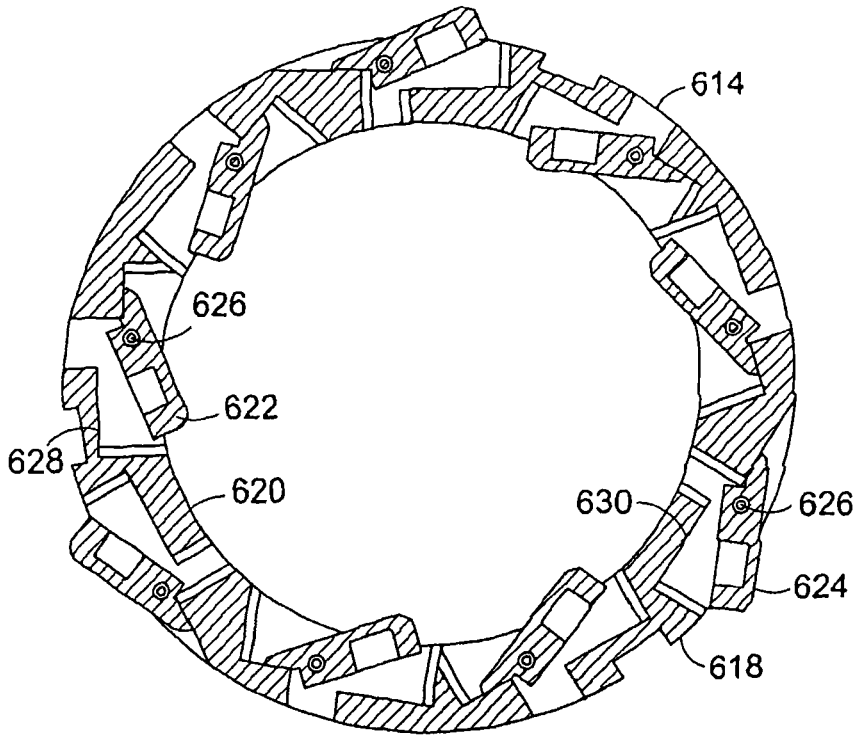
FIG. 22 is a sectional view taken through line C-C on FIG. 21.

Located on the inner surface 620 of the tubular member 614 are first engagement element 622 and located on the outer surface 618 of the tubular member 614 are second engagement elements 624. The first and second engagement elements 622,624 can be best seen on FIG. 22, a sectional view taken through line C-C of FIG. 21. Each engagement element 622,624 is pivoted at one end about a pivot 626. The first engagement element 622 are biased to sit proud of the internal surface 620 of the tubular member 614 and the second engagement elements 624 are biased to sit proud of the outer surface 618 of the tubular member 614, as shown in FIG. 22. Associated with each of the first engagement elements 622 are first tubular member recesses 628 and associated with each of the second engagement elements 624 are second tubular member recesses 630.

Referring to both FIGS. 17 and 22 the anchor setting means 524 in the form of dog nut 526 have a number of second complimentary notches 640 in the internal surface 642 of the dog nut 526. When the rotation of the running adapter 612 is in the direction X, the second engagement elements 624 engage the inner surface 644 of the second complimentary notches 640 thereby driving the dog nut 528, and setting the dogs 522. When the rotation of the running adapter is in direction Y, the inner surface 642 of the dog nut 528 depresses the second engagement 630 elements 624 into the second tubular member recesses 630.

Continuing to refer to FIGS. 17 and 22, the first engagement elements 622 are adapted to engage with first complimentary notches 632 on the outer surface of the mandrel 556. The complimentary notches 632 are separated by fingers 634. The pivotal mounting of the first engagement elements 622 means that when the running adapter 610 is driven in direction Y, the first engagement elements 622 engage with the inner surface 636 of the first complimentary notches 632 thereby rotating the mandrel 556, and setting the seal element 516. When the direction of the running adapter is reversed, to direction X, the upper surface 638 of the fingers 634 press the first engagement elements 622 into the first tubular member recesses 628 such that there is no driving engagement between the running adapter 610 and the mandrel 556.

Referring now to FIG. 23, comprising FIGS. 23*a* to 23*d*, there is shown a schematic of the plug 510 of FIG. 17 being set in a wellbore 700.

The plug 510 is shown in FIG. 23*a* attached to the running adapter 610, which in turn is suspended from a wireline cable 710. The running adapter 610 includes a latch (not shown) which engages a recess 557 (FIG. 18) in the inner surface of the mandrel 556. In FIG. 23*a*, the plug/running adapter 510, 610 is being run into the wellbore 700.

When the plug 510 is in the correct position, shown in FIG. 23*b* the dogs 522 are set in recesses 712. The dogs are set, as described above, by rotating the tubular member 614 (FIG. 21) of the running adapter 610 in a first direction. This rotation drives the dog nut 526 (FIG. 18) towards the dogs 522, which are moved into the position shown in FIG. 23*b* by the action of the dog expander ramp 528 (FIG. 18).

Once the dogs 522 have been set in the recesses 712, and the plug 510 is correctly located in the wellbore 700, the running adapter tubular member 614 is rotated in a second direction, which is opposite to the first direction. This rotation drives the two-part mandrel 556*a*,556*b*, which in turn compresses the frusto-conical washers 714 into a sealing engagement with the wall 716 of the wellbore 700, as shown in FIG. 23*c*. The plug 510 is now set in the wellbore 700.

Finally the running adapter 610 is disconnected by shearing the running adapter latch (not shown) from the plug recess 557 (FIG. 18). The adapter 610 is then withdrawn to surface.

Various modifications and improvements may be made to the embodiments hereinbefore described without departing from the scope of the invention. For example, it will be understood that any suitable form of seal element may be used or slips may be used instead of the dogs described. For example, multiple metal seals could be used or, alternatively, a combination of metal and plastic seals where seal bore damage prevents an all metal seal arrangement from testing. Additionally, with regard to the first described embodiment, although a two trip releasing and recovery of the plug has been described, a single trip wireline tool could be used or the running adapter could be modified to retrieve the plug as well as set the plug.

Those of skill in the art will also recognise that the above described embodiment of the invention provides a plug in which backlash is substantially reduced. The use of a rotary lock mechanism substantially prevents any movement within the plug and is unaffected by vibration which can occur at the wellhead. Furthermore, from a simple rotational input the running adapter produces both rotational and axial force to set and seal the plug in the conduit. Because the running adapter delivers all the force required during setting and because the seal element is a smaller diameter than the diameter of the conduit at the point of sealing, there is no requirement for jarring and no damage is done to the conduit bore.

I claim:

1. A running adapter for setting a plug in a conduit which extends downhole, the running adapter being releasably connectable to the plug and the running adapter comprising:

an input mandrel;

an output mandrel;

an adapter casing; and a locking sleeve, the running adapter being arranged such that rotation of the input mandrel causes axial movement of the output mandrel relative to the adapter casing, and causes rotational movement of the locking sleeve relative to the adapter casing.

2. The running adapter of claim 1, wherein the input mandrel is adapted to be connected to a rotary drive.

3. The running adapter of claim 1, wherein the adapter casing is adapted to engage a plug first body section.

4. The running adapter of claim 1, wherein the output mandrel is adapted to engage a plug second body section.

5. The running adapter of claim 1, wherein the locking sleeve is adapted to engage at least one of a plug seal, and an anchor locking means.

6. The running adapter of claim 1, wherein the locking sleeve is adapted to selectively engage the input mandrel.

7. The running adapter of claim 1, wherein the locking sleeve is adapted to selectively rotate with the input mandrel.

8. The running adapter of claim 1, wherein the running adapter further comprises a locking sleeve clutch to disengage the locking sleeve from the input mandrel.

9. The running adapter of claim 1, wherein the adapter casing is connected to the input mandrel by a threaded connection.

10. The running adapter of claim 1, wherein the output mandrel is axially fixed to the input mandrel.

11. The running adapter of claim 1, wherein the output mandrel is rotationally independent of the input mandrel.

12. The running adapter of claim 1, wherein a bearing interface is provided between the input mandrel and the output mandrel.

13. The running adapter of claim 1, wherein the output mandrel includes a bearing surface.

14. The running adapter of claim 1, further comprising a latch, the latch being adapted to be located, in use, between the output mandrel and a plug second body section.

* * * * *